US010621862B2

(12) United States Patent
Su

(10) Patent No.: US 10,621,862 B2
(45) Date of Patent: Apr. 14, 2020

(54) DRIVING CONTROL METHOD AND APPARATUS FOR INTERSECTION TRAFFIC LIGHT ARRAY

(71) Applicant: Shenzhen Yijie Innovative Technology Co., Ltd., Shenzhen, Guangdong (CN)

(72) Inventor: Xiaofeng Su, Guangdong (CN)

(73) Assignee: Shenzhen Yijie Innovative Technology Co., Ltd., Shenzhen (CN)

( * ) Notice: Subject to any disclaimer, the term of this patent is extended or adjusted under 35 U.S.C. 154(b) by 75 days.

(21) Appl. No.: 15/972,731

(22) Filed: May 7, 2018

(65) Prior Publication Data

US 2018/0253965 A1 Sep. 6, 2018

Related U.S. Application Data

(63) Continuation-in-part of application No. PCT/CN2016/103926, filed on Oct. 30, 2016.

(30) Foreign Application Priority Data

Nov. 6, 2015 (CN) ..... 2015 1 0753648
Mar. 17, 2016 (CN) ..... 2016 1 0159110

(51) Int. Cl.
*G08G 1/07* (2006.01)
*E01C 17/00* (2006.01)
*G08G 1/095* (2006.01)

(52) U.S. Cl.
CPC ..... *G08G 1/07* (2013.01); *E01C 17/00* (2013.01); *G08G 1/095* (2013.01)

(58) Field of Classification Search
CPC ... E01F 9/576; E01F 9/582; E01F 9/07; E01F 9/20; E01F 9/571; E01F 15/00;
(Continued)

(56) References Cited

U.S. PATENT DOCUMENTS 7,468,680 B2 12/2008 Heffernan
2013/0282271 A1 10/2013 Rubin et al.

FOREIGN PATENT DOCUMENTS

CN 1210318 A 3/1999
CN 1308306 A 8/2001
(Continued)

OTHER PUBLICATIONS

Extended European search report issued in corresponding European application No. 16861511.0 dated Jun. 11, 2019.
(Continued)

*Primary Examiner* — Anthony R Jimenez
(74) *Attorney, Agent, or Firm* — Young Basile Hanlon & MacFarlane, P.C.

(57) ABSTRACT

A driving control method for an intersection traffic light array is provided. The intersection traffic light array includes Nxi horizontal ground traffic light sets. The Nxi horizontal ground traffic light sets include a horizontal ground traffic light set pxi which is disposed at an intersection safety line position of an entrance lane xi of a planar intersection. The Nxi horizontal ground traffic light sets further include a horizontal ground traffic light set qxi which is disposed at a stop line position of the entrance lane xi. Each horizontal ground traffic light set includes at least one traffic light, and part or all of traffic lights of a horizontal ground traffic light set i are provided with a wireless driving signal input port and/or a wired driving signal input port.

20 Claims, 12 Drawing Sheets

(58) Field of Classification Search
CPC ..... E01F 15/006; E01C 17/00; G08G 1/07; G08G 1/095; G08G 1/09; G08G 1/081
USPC ..... 701/117
See application file for complete search history.

(56) References Cited

FOREIGN PATENT DOCUMENTS

| | | | |
|---|---|---|---|
| CN | 1407518 | A | 4/2003 |
| CN | 101630442 | A | 1/2010 |
| CN | 101794517 | A | 8/2010 |
| CN | 102071609 | A | 5/2011 |
| CN | 102426790 | A | 4/2012 |
| CN | 202925489 | U | 5/2013 |
| CN | 203012978 | U | 6/2013 |
| CN | 103632551 | A | 3/2014 |
| CN | 205656763 | U | 10/2016 |
| CN | 205656767 | U | 10/2016 |
| EP | 0843296 | A1 | 5/1998 |

OTHER PUBLICATIONS

International search report issued in corresponding international application No. PCT/CN2016/103926 dated Jan. 26, 2017.

DRIVING CONTROL METHOD AND APPARATUS FOR INTERSECTION TRAFFIC LIGHT ARRAY

CROSS-REFERENCE TO RELATED APPLICATION(S)

This application is a continuation-in-part of International Application No. PCT/CN2016/103926, filed on Oct. 30, 2016, which claims priorities to Chinese Patent Application No. 201510753648.0, filed on Nov. 6, 2015 and Chinese Patent Application No. 201610159110.1, filed on Mar. 17, 2016, the contents of all of which are hereby incorporated by reference in their entireties.

TECHNICAL FIELD

The present disclosure relates to the field of traffic electronics, and particularly to a driving control method for an intersection traffic light array. The driving control method for an intersection traffic light array can be applied to an intelligent electronic police (such as an intelligent electronic police traffic control system) or other related systems.

BACKGROUND

At present, with the acceleration of urbanization and the improvement of peoples' living standards, the number of motor vehicles in many large cities has been increasing year by year, leading to increasingly serious traffic jam.

Urban traffic jams have had a certain impact on people's daily travel, and even have constrained the economic development to some extent. Therefore, how to "tackle jams" has become a hot topic for many engineering technicians. For example, how to improve traffic efficiency and safety controllability of a vehicle at a plane intersection is a technical issue that is worth studying.

SUMMARY

Implementations of the disclosure provide a driving control method for an intersection traffic light array.

According to a first aspect of the disclosure, there is provided a driving control method for an intersection traffic light array. The intersection traffic light array includes Nxi horizontal ground traffic light sets. The Nxi horizontal ground traffic light sets include a horizontal ground traffic light set pxi which is disposed at an intersection safety line position of an entrance lane xi of a plane intersection. The Nxi horizontal ground traffic light sets further include a horizontal ground traffic light set qxi which is disposed at a stop line position of the entrance lane xi, where Nxi is an integer greater than 1. Each horizontal ground traffic light set of the Nxi horizontal ground traffic light sets includes at least one traffic light, and part or all of traffic lights of a horizontal ground traffic light set i have at least one of a wireless driving signal input port and a wired driving signal input port. The horizontal ground traffic light set i is one or any one of the Nxi horizontal ground traffic light sets.

The driving control method includes: driving the Nxi horizontal ground traffic light sets to emit an allow-to-travel light signal sequentially from the horizontal ground traffic light set qxi when there is an overlap time length $T_{cd_xi}$ left to the end of a last intersection conflict control phase of a control phase of the entrance lane xi. The closer a distance between a horizontal ground traffic light set among the Nxi horizontal ground traffic light sets and the horizontal ground traffic light set qxi is, an earlier a starting time when the horizontal ground traffic light set is driven to emit the allow-to-travel light signal is. A starting time of a allow-to-travel light signal emitted by driving the horizontal ground traffic light set pxi is later than that emitted by driving any horizontal ground traffic light set among the Nxi horizontal ground traffic light sets, and an interval $T_{\Delta_pxi_qxi}$ of the starting time of the allow-to-travel light signal emitted by the horizontal ground traffic light set pxi and a starting time of an allow-to-travel light signal emitted by the horizontal ground traffic light set qxi is equal to the overlap time length $T_{cd_xi}$.

A distance between any two adjacent horizontal ground traffic light sets among the Nxi horizontal ground traffic light sets is equal, partially equal, or not equal. Alternatively, among the Nxi horizontal ground traffic light sets, the farther two adjacent horizontal ground traffic light sets from the horizontal ground traffic light set pxi is, the smaller a distance between the two adjacent horizontal ground traffic light sets is (in a driving direction of the entrance lane xi, the distance between the two adjacent horizontal ground traffic light sets among the Nxi horizontal ground traffic light sets gradually increases). Alternatively, among the Nxi horizontal ground traffic light sets, the closer a distance among two adjacent horizontal ground traffic light sets and the horizontal ground traffic light set pxi is, the larger a distance between the two adjacent horizontal ground traffic light sets is (in the driving direction of the entrance lane xi, the distance between the two adjacent horizontal ground traffic light sets among the Nxi horizontal ground traffic light sets gradually decreases). It is to be noted that, a distance between two adjacent horizontal ground traffic light sets among the Nxi horizontal ground traffic light sets may also change arbitrarily or in other change laws, and may not necessarily change in the above-mentioned change law of gradual decrease or increase in a certain direction.

Combined with the first aspect, as a first possible implementation in the first aspect, guide speed presented when the Nxi horizontal ground traffic light sets are driven to emit the allow-to-travel light signal sequentially from the horizontal ground traffic light set qxi is constant guide speed or variable guide speed.

Combined with the first possible implementation in the first aspect, as a second possible implementation in the first aspect, an interval length $T_{\Delta g_i_qxi}$ starting time of an allow-to-travel light signal emitted by the horizontal ground traffic light set i relative to the starting time of the allow-to-travel light signal emitted by the horizontal ground traffic light set qxi is expressed as $$T_{\Delta g_i_qxi} = T_{cd_xi}\frac{L_{i_qxi}}{L_{YD_xi}},$$

where $L_{YD_xi}$ represents a distance between the horizontal ground traffic light set pxi and the horizontal ground traffic light set qxi, and $L_{i_qxi}$ represents a distance between the horizontal ground traffic light set i and the horizontal ground traffic light set qxi.

Combined with the first possible implementation in the first aspect, as a third possible implementation in the first aspect, an interval length $T_{\Delta g_i_qxi}$ of a starting time of an allow-to-travel light signal emitted by the horizontal ground traffic light set i relative to the starting time of the allow-to-travel light signal emitted by the horizontal ground traffic light set qxi is expressed as $$T_{\Delta g_i_qxi} = T_{cd_xi}\sqrt{\frac{L_{i_qxi}}{L_{YD_xi}}},$$

wherein $L_{YD_xi}$ represents a distance between the horizontal ground traffic light set pxi and the horizontal ground traffic light set qxi, and $L_{i_qxi}$ represents a distance between the horizontal ground traffic light set i and the horizontal ground traffic light set qxi.

In some possible implementations, the method further includes: driving the Nxi horizontal ground traffic light sets to synchronously emit a warn-to-travel light signal when there is a transition phase time length left to the end of the control phase of the entrance lane xi; or driving the Nxi horizontal ground traffic light sets to synchronously emit the warn-to-travel light signal when there is a clear phase time length plus the transition phase time length left to the end of the control phase of the entrance lane xi; or driving the Nxi horizontal ground traffic light sets from the horizontal ground traffic light set qxi to sequentially emit the warn-to-travel light signal when there is the clear phase time length plus the transition phase time length left to the end of the control phase of the entrance lane xi, where the closer a distance between a horizontal ground traffic light set among the Nxi horizontal ground traffic light sets and the horizontal ground traffic light set qxi is, the earlier a starting time when the horizontal ground traffic light set emits a warn-to-travel light signal is, and a starting time of a warn-to-travel light signal emitted by the horizontal ground traffic light set pxi is later than that emitted by any horizontal ground traffic light set among the Nxi horizontal ground traffic light sets; or driving the Nxi horizontal ground traffic light sets from the horizontal ground traffic light set qxi to sequentially emit the warn-to-travel light signal when there is the transition phase time length left to the end of the control phase of the entrance lane xi, where the closer a distance between a horizontal ground traffic light set among the Nxi horizontal ground traffic light sets and the horizontal ground traffic light set qxi is, the earlier a starting time when the horizontal ground traffic light set emits a warn-to-travel light signal is, and the starting time of the warn-to-travel light signal emitted by the horizontal ground traffic light set pxi is later than that emitted by any horizontal ground traffic light set among the Nxi horizontal ground traffic light sets.

In some possible implementations, the method further includes: driving the Nxi horizontal ground traffic light sets to synchronously emit a prohibit-to-travel light signal when the control phase of the entrance lane xi ends; or driving the Nxi horizontal ground traffic light sets to synchronously emit the prohibit-to-travel light signal when there is the clear phase time length left before the control phase of the entrance lane xi ends; or driving the Nxi horizontal ground traffic light sets to sequentially emit the prohibit-to-travel light signal from the horizontal ground traffic light set qxi when there is the clear phase time length left to the end of the control phase of the entrance lane xi, where the closer a distance between a horizontal ground traffic light set among the Nxi horizontal ground traffic light sets and the horizontal ground traffic light set qxi is, the earlier a starting time when the horizontal ground traffic light set emits a prohibit-to-travel light signal is, and a starting time of a prohibit-to-travel light signal emitted by the horizontal ground traffic light set pxi is later than that emitted by any horizontal ground traffic light set among the Nxi horizontal ground traffic light sets.

According to a second aspect of the disclosure, there is provided a driving control apparatus for an intersection traffic light array. The apparatus includes a driving interface, a processor, and a memory. The memory is configured to store a set of executable program codes. The intersection traffic light array includes Nxi horizontal ground traffic light sets. The Nxi horizontal ground traffic light sets include a horizontal ground traffic light set pxi which is disposed at an intersection safety line position of an entrance lane xi of a plane intersection. The Nxi horizontal ground traffic light sets further include a horizontal ground traffic light set qxi which is disposed at a stop line position of the entrance lane xi, and Nxi is an integer greater than 1. Each horizontal ground traffic light set of the Nxi horizontal ground traffic light sets includes at least one traffic light, and part or all of traffic lights of a horizontal ground traffic light set i have at least one of a wireless driving signal input port and a wired driving signal input port. The horizontal ground traffic light set i is one or any one of the Nxi horizontal ground traffic light sets.

The processor is configured to invoke the executable program codes to: drive the Nxi horizontal ground traffic light sets to emit an allow-to-travel light signal sequentially from the horizontal ground traffic light set qxi when there is an overlap time length $T_{cd_xi}$ left to the end of a last intersection conflict control phase of a control phase of the entrance lane xi. The closer a distance between a horizontal ground traffic light set among the Nxi horizontal ground traffic light sets and the horizontal ground traffic light set qxi is, the earlier a starting time when the horizontal ground traffic light set is driven to emit an allow-to-travel light signal is. A starting time of an allow-to-travel light signal emitted by driving the horizontal ground traffic light set pxi is later than that emitted by driving any horizontal ground traffic light set among the Nxi horizontal ground traffic light sets, and an interval $T_{\Delta_pxi_qxi}$ of the starting time of the allow-to-travel light signal emitted by the horizontal ground traffic light set pxi and a starting time of an allow-to-travel light signal emitted by the horizontal ground traffic light set qxi is equal to the overlap time length $T_{cd_xi}$.

According to a third aspect of the disclosure, there is provided a non-transitory computer storage medium, wherein the non-transitory computer storage medium is configured to store programs that, when executed, are operable to execute the method described in the first aspect of the disclosure.

According to technical schemes of the implementations of the disclosure, the intersection traffic light array is deployed at the entrance lane xi of the plane intersection. The intersection traffic light array includes the Nxi horizontal ground traffic light sets, where the Nxi horizontal ground traffic light sets include the horizontal ground traffic light set pxi which is disposed at the intersection safety line position of the entrance lane xi of the plane intersection and the horizontal ground traffic light set qxi which is disposed at the stop line position of the entrance lane xi. A lane section defined between the intersection safety line and the stop line of the entrance lane xi can form an entrance guide area (the entrance guide area can be regarded as a vehicle pre-acceleration area), which provides a certain space for the vehicle to accelerate in advance when passing through the intersection. In addition, the Nxi horizontal ground traffic light sets provide certain hardware foundation for controlling the speed at which the vehicle enters the intersection (also be regarded as the speed at which the vehicle exits the entrance guide area) and a driving state of the vehicle at the entrance guide area. The foundation, in turn, has made it possible to increase the traffic efficiency of the vehicle at the plane intersection. The entrance guide area can be divided into a plurality of entrance lane sections by the Nxi horizontal ground traffic light sets. In this way, it is possible to accurately control the driving state of the vehicle in the entrance guide area and the speed of the vehicle entering the intersection by using the light signals emitted by the Nxi horizontal ground traffic light set, thereby improving safety and controllability of vehicle traffic at the intersections. Moreover, the ground traffic light set is more convenient for the driver to recognize the corresponding traffic control signal. This will further improve the safety and controllability of vehicle traffic at the intersection. For example, the Nxi horizontal ground traffic light sets are driven to emit the allow-to-travel light signal sequentially from the horizontal ground traffic light set qxi when there is the overlap time length Tcd_xi left to the end of the last intersection conflict control phase of the control phase of the entrance lane xi, where the closer the distance between the horizontal ground traffic light set among the Nxi horizontal ground traffic light sets and the horizontal ground traffic light set qxi is, the earlier the starting time when the horizontal ground traffic light set is driven to emit the allow-to-travel light signal is. As a result, it can be considered that each horizontal ground traffic light set among the Nxi horizontal ground traffic light sets starts to issue the allow-to-travel light signal in a certain order. This lays the foundation for reasonable and appropriate guidance of the time and speed at which the vehicle passes through the entrance guide area. For example, it helps to guide the vehicle to exit, in a safe, controlled and efficient way, from the entrance guide area under the guide speed presented when the Nxi horizontal ground traffic light sets issue the light signals, which is conducive for the vehicle to cross the intersection in the safe, controlled and efficient way.

BRIEF DESCRIPTION OF THE DRAWINGS

To describe the technical solutions in the implementations of the present disclosure more clearly, the following briefly introduces the accompanying drawings required for describing the implementations. Apparently, the accompanying drawings in the following description illustrate some implementations of the present disclosure. Those of ordinary skill in the art may also obtain other drawings based on these accompanying drawings without creative efforts.

DETAILED DESCRIPTION

Implementations of the disclosure provide a driving control method for an intersection traffic light array and related apparatuses, to help improve traffic efficiency and safety controllability of a vehicle at a plane intersection. The intersection traffic light array and a system for the intersection traffic light can be applied to an intelligent electronic police or other related systems.

The terms "include", "comprise", and "have" as well as variations thereof used in the specification, the claims, and the accompany drawings of the present disclosure are intended to cover non-exclusive inclusion. For example, a process, method, system, product, or apparatus including a series of steps or units is not limited to the listed steps or units, it can optionally include other steps or units that are not listed; alternatively, other steps or units inherent to the process, method, product, or apparatus can be included either. Moreover, the terms "first", "second", "third", and "fourth" are used for distinguishing between different objects rather than describing a particular order.

Hereinafter, related terms are interpreted by examples.

Figure 1A:
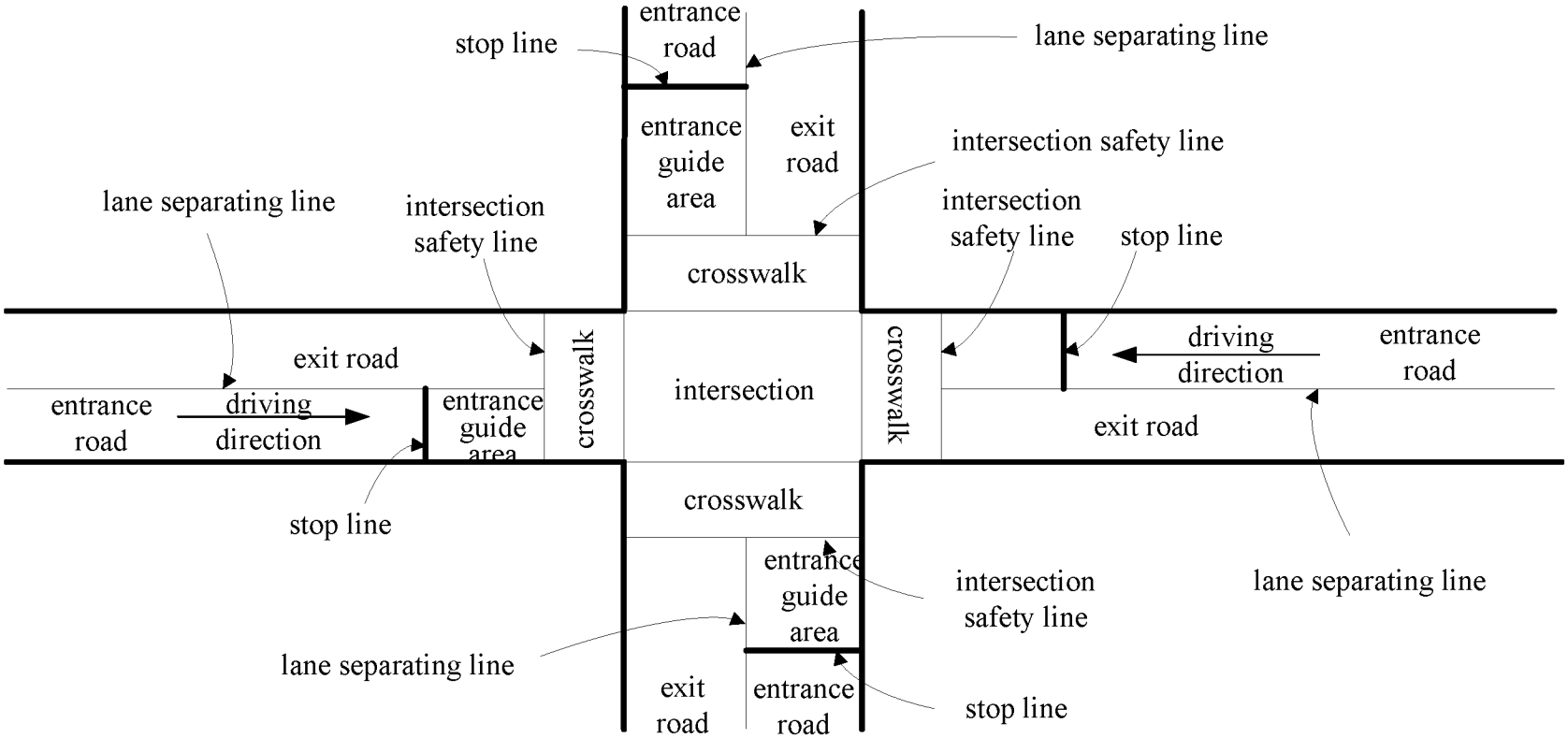
FIGS. 1A-1B are schematic diagrams illustrating layouts of two types of a plane intersection according to implementations of the present disclosure.
Figure 1B:
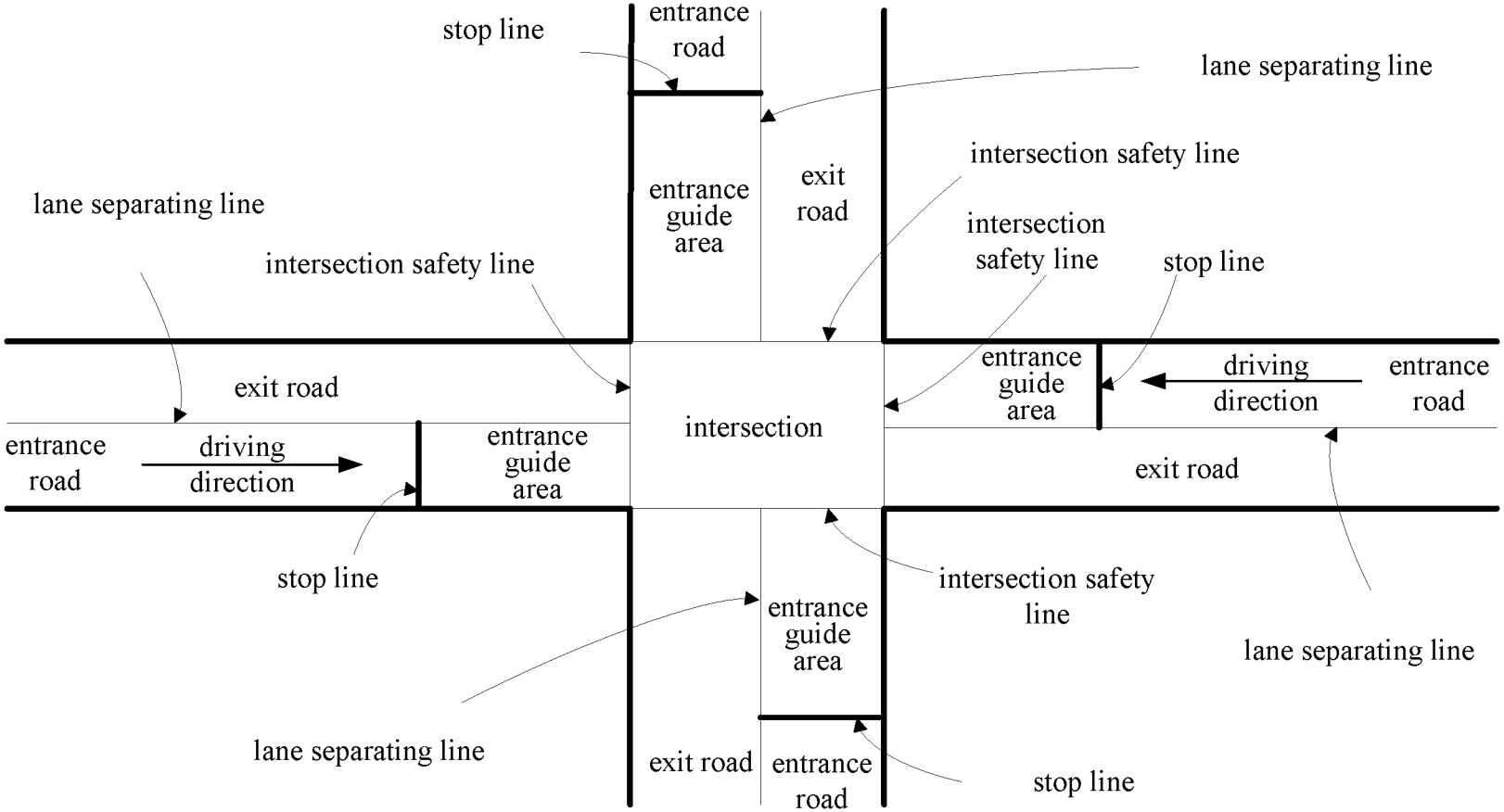

Referring to FIGS. 1A-1B, relative positions of a stop line and an intersection security line disposed at an entrance road of a plane intersection in the implementation of the disclosure may be shown in FIG. 1A or FIG. 1B. There is also a crosswalk (also called pedestrian crossing) at the plane intersection shown in FIG. 1A, but there is no crosswalk at the plane intersection shown in FIG. 1B. It is also possible that a crosswalk is provided between some of the lanes and the intersection of the plane intersection (this scene is not shown in FIG. 1A and FIG. 1B). In FIG. 1A to FIG. 1B, cross-shaped plane intersections are used as examples. However, the plane intersections may also be T-shaped plane intersections or other shapes of plane intersections.

The entrance road of the plane intersection can also be called an entryway. The entrance road at the plane intersection may include one or more entrance lanes. The entrance lane may also be referred to as an entryway lane. An exit road at the plane intersection can also be called a downstream road. The exit road at the plane intersection may include one or more exit lanes. The exit lane may also be referred to as a downstream lane. In the related drawings of the implementations of the present disclosure, the entrance road is mainly located on the right side of the corresponding exit road, while the entrance road in some countries may also be located on the left side of the corresponding exit road, and so on.

If an entrance road includes multiple entrance lanes, directions of the multiple entrance lanes may be the same, the same in part, or different. The direction of the entrance lane can be divided into left-turn, straight, right-turn, and round-turn. For example, if an entrance road X includes six entrance lanes, assuming that two of the six entrance lanes mentioned above are guided to turn left, the two entrance lanes may be called left-turn entrance lanes of the entrance road X, and the left-turn entrance lane may be simplified as a left-turn lane. Assuming that the other three entrance lanes of the six entrance lanes are guided straight, the three entrance lanes may be called straight entrance lanes of the entrance road X, and the straight entrance lane may be simplified as a straight lane. Assume that the remaining one entrance lane of the six entrance lanes is guided to turn right, the one entrance lane may be called a right-turn entrance lane of the entrance road X, and the right-turn entrance lane may be simplified as a right-turn lane, and so on.

For example, a cross-shaped plane intersection (e.g., as shown in FIGS. 1A-1B) may generally include four entrance roads and four exit roads, where each entrance road may include one or more entrance lanes and each exit road may include one or more exit lanes. A T-shaped plane intersection generally includes three entrance roads and three exit roads, where each entrance road may include one or more entrance lanes and each exit road may include one or more exit lanes. The number of entrance roads and exit roads at some plane intersections may not be the same. For example, a certain cross-shaped intersection may also include only three entrance roads but four exit roads.

In some cases, directions of certain entrance lanes may be changeable (that is, not fixed). For example, at some time periods, a certain entrance lane is a left-turn lane, but at other time periods, it may be a straight lane. This kind of lane can be referred to as a direction-variable lane. Other similar cases can also be concluded in a similar way.

In some cases, directions of certain entrance lanes may be multiple. For example, a certain entrance lane may be a straight lane, and it may also be a right-turn lane. As one implementation, for example, the right-most entrance lane of the certain entrance lane may be both a straight lane and a right-turn lane. Such a lane may be referred to as a multiple direction lane or a composite direction lane. Other similar situations may be analogized.

A driving direction of a lane is generally fixed, but in some cases, the driving direction of some lanes may also be variable (that is, non-fixed). For example, the tidal lane is a typical lane with variable driving directions. A lane with variable driving directions can also be referred to as a driving-direction-variable lane. The driving direction of the lane may be, for example, east (i.e., eastbound), west (i.e., westbound), south (i.e., southbound), and north (i.e., southbound). For example, when a driving direction of an entrance road is east, the left-turn lane at the entrance road is also called the east left-turn lane. In some scenes, the east left-turn lane is also called the eastbound left-turn lane. The straight lane at the entrance road is also called the east straight lane. In some scenes, the east straight lane is also called the eastbound straight lane, and so on.

In the implementations of the present disclosure, the intersection safety line of a lane (such as an entrance lane and an exit lane) at a plane intersection refers to a lane border line adjacent to or intersecting with the intersection, or a lane border line adjacent to or intersecting with the crosswalk. A stop line of the entrance lane may be set at the intersection safety line position of the entrance lane. Alternatively, the stop line of the entrance lane may also be set behind the intersection safety line of the entrance lane with respect to the driving direction of the entrance lane. In the related technology, the stop line of the entrance lane is generally set at the intersection safety line position of the entrance lane, that is, the stop line and the intersection safety line are combined in a spatial position. In the implementations of the present disclosure, the stop line of the entrance lane is set behind the intersection safety line of the entrance lane with respect to the driving direction of the entrance lane for example. That is to say, the solution of the implementations of the present disclosure breaks through the inertial thinking that the stop line is set at the intersection safety line position of the entrance lane and separates the stop line and the intersection safety line of the entrance lane in space boldly and innovatively. That is, the stop line of the entrance lane is moved backwards from the intersection safety line of the entrance lane, which forms a new stop line layout. The setting position of the stop line of the entrance lane may be relatively fixed, that is, the distance between the intersection safety lane of the entrance lane and the stop line of the entrance lane may be relatively fixed. The setting position of the stop line of the entrance lane may also be adjusted adaptively based on factors such as environmental factors and scene requirements.

Vehicles on each lane of a plane intersection may be allowed to travel (allow-to-travel for short), prohibited to travel (prohibit-to-travel for short), or warned to travel (warn-to-travel for short) under control of a traffic light. In general, the traffic light corresponding to a certain entrance lane can control whether the vehicles on the entrance lane are allowed, warned, or prohibited. A phase that controls the vehicle at the entrance lane to go can be referred to as go phase (also called release phase or permission phase) of the entrance lane. In the related technology, since the color of the light signal emitted by the corresponding traffic light is green during the go phase, the go phase is generally also referred to as the green light phase. In the technical solution of the implementations of the present disclosure, the color of the light signal emitted by the corresponding traffic light is not limited to green during the go phase, and can be extended to any single color or several color combinations that can be used to indicate that the vehicle is allowed to travel. That the color of the light signal emitted by the corresponding traffic light is green during the go phase is only an optional implementation in the implementations of the present disclosure. A phase that controls the vehicle at the entrance lane to stop can be referred to as stop phase of the entrance lane. In the related technology, since the color of the light signal emitted by the corresponding traffic light is red during the stop phase, the stop phase is generally also referred to as the red light phase. In the technical solution of the implementations of the present disclosure, the color of the light signal emitted by the corresponding traffic light is not limited to red during the stop phase, and can be extended to any single color or several color combinations that can be used to indicate that the vehicle is prohibited to travel. That the color of the light signal emitted by the corresponding traffic light is red during the stop phase is only an optional implementation in the implementations of the present disclosure. Similarly, a phase that controls the vehicle at the entrance lane to be warned can be referred to as warn phase (also called transition phase) of the entrance lane. In the related technology, since the color of the light signal emitted by the corresponding traffic light is yellow during the warn phase, the warn phase is generally also referred to as the yellow light phase. In the technical solution of the implementations of the present disclosure, the color of the light signal emitted by the corresponding traffic light is not limited to yellow during the warn phase, and can be extended to any single color or several color combinations that can be used to indicate that the vehicle is warned to travel. That the color of the light signal emitted by the corresponding traffic light is yellow during the warn phase is only an optional implementation in the implementations of the present disclosure.

As one implementation, "phase" mentioned in some traffic regulations generally defaults to the go phase (such as the green light phase), that is, in some traffic regulations, the go phase (such as the green light phase) is abbreviated as phase. Even concepts of the stop phase and the transition phase are not concerned in these traffic regulations. The solution of the implementations of the present disclosure is mainly aimed at implementing relatively fine-grained management for each lane, and thus distinguishes three different phase concepts of the go phase, the stop phase, and the transition phase.

Figure 2A:
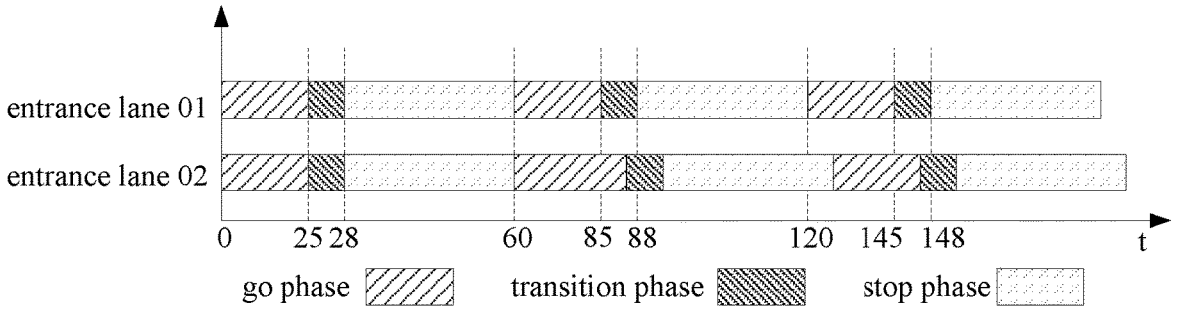
FIGS. 2A-2B are schematic diagrams illustrating phase cycles of several entrance lanes according to implementations of the present disclosure.
Figure 2B:
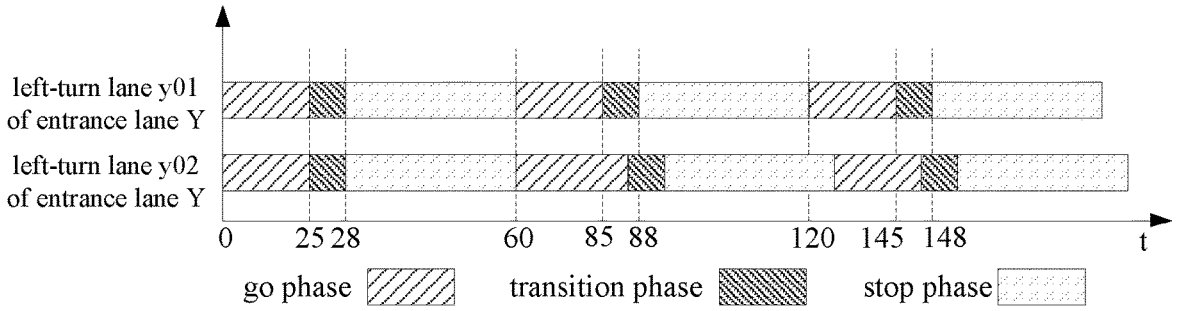

In general, the continuous go phase, transition phase, and stop phase of an entrance lane can form a single-phase cycle of the entrance lane, and a total duration of adjacent two phase cycles can be fixed (a total duration of adjacent two phase cycles of the entrance lane 01 illustrated in FIG. 2A is 60 seconds) or is not fixed (a total duration of adjacent two phase cycles of the entrance lane 02 illustrated in FIG. 2A is not equal). The phase cycles of two entrance lanes with the same direction of the same entrance road may be set to be the same (e.g., phase cycles of the two left-turn lanes of the entrance lane Y shown in FIG. 2B are the same) or different. The phase cycles of two entrance lanes with different directions of the same entrance road may be set to be the same or different. In some scenarios, the transition phase may even be absent. In this case, the phase cycle only includes the go phase and the stop phase, but does not include the transition phase.

Figure 1C:
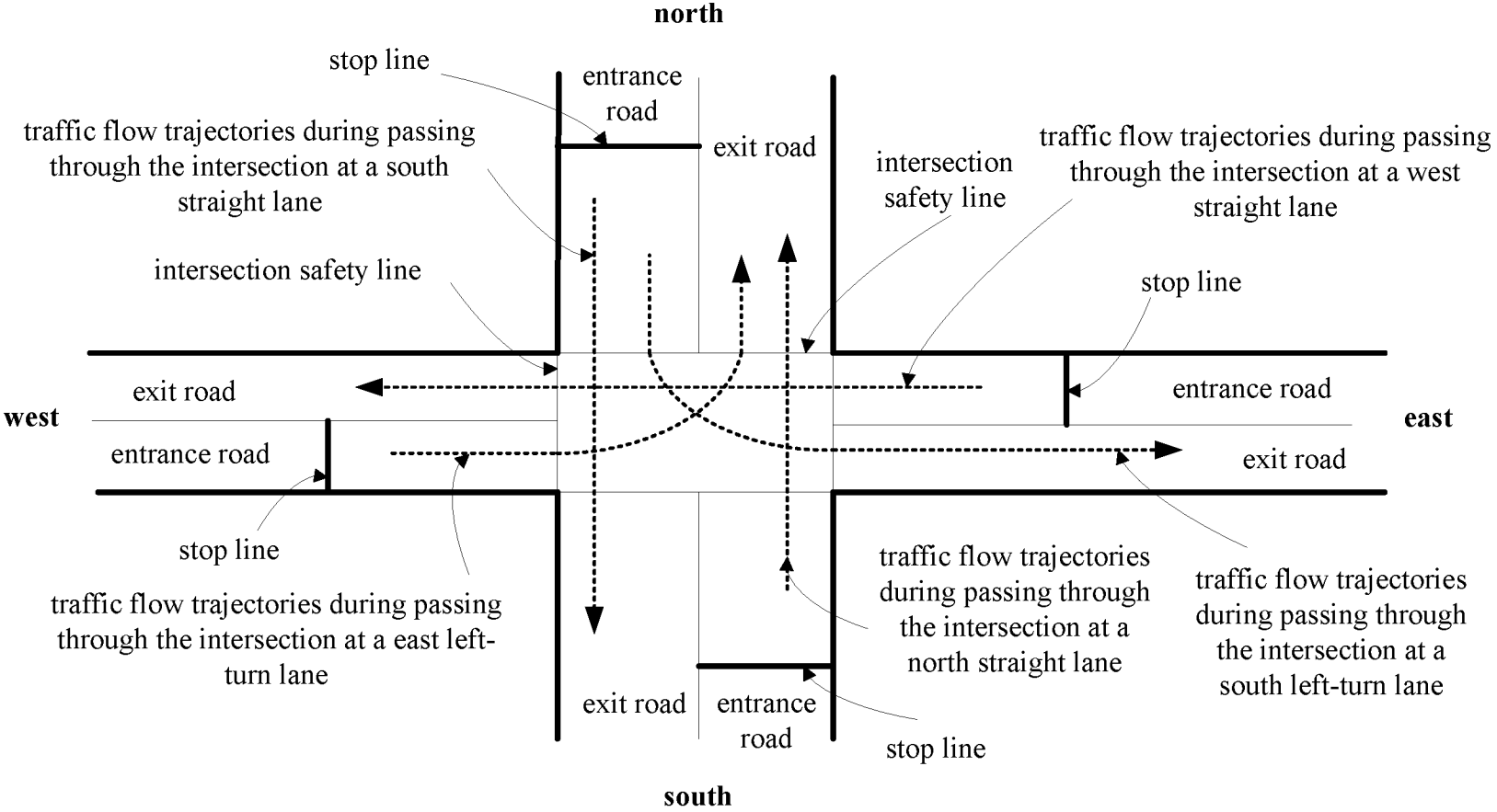
FIG. 1C is a schematic diagram illustrating traffic flow trajectories on several lanes of a plane intersection according to an implementation of the present disclosure.

The concept of "intersection conflict lane" is proposed hereinafter. The intersection conflict lane is a relative concept. When two entrance lanes are intersection conflict lanes mutually, it means that there is a cross (interweaving) between traffic flow trajectories during passing through the intersection at the two entrance lanes. That is, when any two entrance lanes are intersection conflict lanes mutually, there is a cross (interweaving) between traffic flow trajectories during passing through the intersection at the any two entrance lanes. For example, if the east-west straight lane and the north-south straight lane are intersection conflict lanes, there is a cross between traffic flow trajectories during passing through the intersection at the east-west straight lane and the north-south straight lane. As illustrated in FIG. 1C, if two traffic flows at the west straight lane and the south straight lane passes through the intersection at the same time, the two traffic flows will clash at the intersection. FIG. 1C also exemplifies that the west straight lane and the north straight lane are also intersection conflict lanes, and other lanes that are the intersection conflict lanes can be analogized. The intersection conflict lane in the implementations of the present disclosure may be simplified as a conflict lane.

The concept of "intersection conflict go phase" is proposed hereinafter. The intersection conflict go phase is also a relative concept. In short, go phases of two entrance lanes that are intersection conflict lanes mutually are intersection conflict go phases mutually. Similarly, transition phases of two entrance lanes that are intersection conflict lanes mutually are intersection conflict transition phases mutually. In the implementations of the present disclosure, the intersection conflict go phase may be simplified as the conflict go phase and the intersection conflict transition phase can be simplified as conflict transition phase.

Figure 2C:
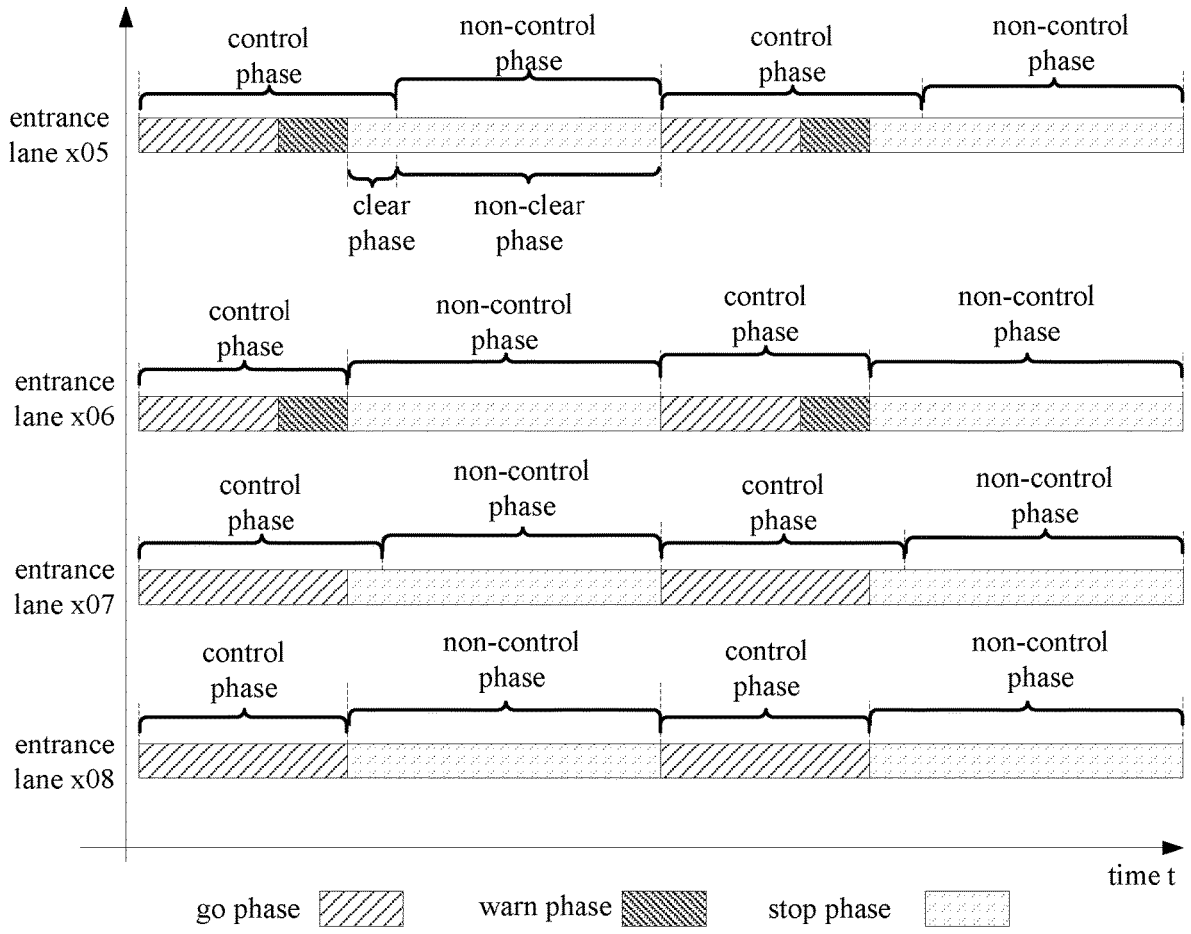
FIG. 2C is a schematic diagram illustrating a composition of several types of control phase and non-control phase according to an implementation of the present disclosure.

The concepts of "control phase" and "non-control phase" are proposed below. The control phase of the entrance lane is used to control traffic on the entrance lane to cross the intersection, which may indicate that the traffic on the entrance lane has gained the right to cross the intersection. Vehicles that pass through a stop line of an entrance lane at the end of the transition phase (if exists) or the end of the go phase usually take a certain amount of time to cross the intersection. In order to avoid the conflict at the intersection between these vehicles and vehicles entering the intersection from another intersection conflict lane, some traffic regulations suggest that these vehicles that pass through the stop line at the end of the transition phase (if exists) or the end of the go phase need to be given about 2 seconds to be ensured to cross the intersection safely. In some traffic regulations, time for clearing is referred to as clear phase (the clear phase is similar to intersection full red period referred in some traffic regulations). In general, on the time axis, control phase+non-control phase of an entrance lane=the go phase+the stop phase+the transition phase (if exists) of the entrance lane. The stop phase may include clear phase and non-clear phase. The clear phase may not be necessary in some special cases. When the clear phase is absent, the stop phase may be equal to the non-control phase. That is, the non-control phase of the entrance lane is part of or the entire stop phase of the entrance lane. When there is transition phase and clear phase, the control phase may include go phase, transition phase, and clear phase. When there is transition phase and there is no clear phase, the control phase includes go phase and transition phase. When there is no transition phase but there is clear phase, the control phase includes go phase and clear phase. When there is no transition phase and clear phase, the control phase can be equal to go phase. For example, FIG. 2C exemplarily shows that control phase of an entrance lane (e.g., entrance lane x05) includes go phase, transition phase, and clear phase; control phase of an entrance lane (e.g., entrance lane x07) may include go phase and clear phase; control phase of an entrance lane (e.g., entrance lane x06) includes the go phase and transition phase; or control phase of an entrance lane (e.g., entrance lane x08) may be equivalent to the go phase. The phase mentioned in some traffic regulations may also defaults to control phase, that is, in these traffic regulations, control phase may be simply referred to as phase.

The concept of "intersection conflict control phase" is proposed hereinafter. The intersection conflict control phase is a relative concept. In short, control phases of two entrance lanes that are intersection conflict lanes mutually are intersection conflict control phases mutually. The intersection conflict control phase may be simplified as the conflict control phase.

The above description of various concepts (for example, "phase" concept) is mainly carried out with regard to lanes as an example. And some concepts for lanes (such as certain "phase" concepts) can also be applied to scenes for crosswalks. In a broad sense, crosswalks and lanes can be seen as passways. The passways are roads used for passing objects to pass. The passways include crosswalks and lanes (such as entrance lanes, exit lanes, and the like at the plane intersection). Objects that pass on the passway are called passing objects (passing objects may be pedestrians or vehicles, etc.), and an object flow passing on the passway is called a passing object flow (simplified as a passing flow). Objects passing through the crosswalk may include pedestrians, etc. An object flow passing through the crosswalk includes a pedestrian flow and the like. For example, an object that passes on a lane may include a vehicle and the like, and an object flow passing on a lane includes a traffic flow and the like.

For crosswalk scenes, there may be concepts such as go phase, transition phase, and stop phase of the crosswalk, and there may be concepts such as control phase and non-control phase of the crosswalk. Crosswalks and certain lanes may also be conflict roads with each other, because there may be a cross between the pedestrian flow on the crosswalk and the traffic flow on a lane. In a broad sense, when there is a cross between trajectories of passing flows on two passways (the two passways may be lanes, or possibly one is a lane and the other is a crosswalk), the two passways can be called conflict roads. If passing flows on two passways that are conflict roads with each other passes through at the same time period, the passing flows on the passways may conflict. If a conflict road of a passway (such as a lane or crosswalk) is a lane, the conflict road may also be referred to as a conflict lane; if a conflict road of a passway is a crosswalk, the conflict road may also be referred to as a conflict crosswalk. There may be conflict between lanes and lanes, and lanes and crosswalks may also conflict with each other. Among them, conflict lanes and conflict crosswalks may be collectively referred to as conflict roads.

To simplify description, in the description of the present disclosure, a light signal prohibiting to travel may be simply referred to as a prohibit-to-travel light signal or an A1 light signal. A light signal allowing to travel may be referred to as an allow-to-travel light signal, a passing light signal, or an A2 light signal for short. A light signal warning to travel may be referred to as a warn-to-travel light signal or an A3 light signal. As one implementation, the prohibit-to-travel light signal is a light signal for instructing to prohibit a passing object (such as a vehicle or a pedestrian, etc.) at a corresponding passway (such as a lane or a crosswalk, etc.) from travelling, for example, vehicles at a lane are prohibited to travel during a traffic light emitting the prohibit-to-travel light signal, or pedestrians at a crosswalk are prohibited to travel during a traffic light at the crosswalk emitting the prohibit-to-travel light signal. The allow-to-travel light signal is a light signal for instructing to allow a passing object (such as a vehicle or a pedestrian, etc.) at a corresponding passway (such as a lane or a crosswalk, etc.) to travel, for example, vehicles at a lane are allowed to travel during a traffic light emitting the allow-to-travel light signal, or pedestrians at a crosswalk are allowed to travel during a traffic light at the crosswalk emitting the allow-to-travel light signal. The warn-to-travel light signal is a light signal for instructing to warn a passing object (such as a vehicle or a pedestrian, etc.) at a corresponding passway (such as a lane or a crosswalk, etc.) to travel, for example, vehicles at a lane are warned to travel during a traffic light emitting the warn-to-travel light signal, or pedestrians at a crosswalk are warned to travel during a traffic light at the crosswalk emitting the warn-to-travel light signal. Other scenes can be analogized.

The presentation forms of the prohibit-to-travel light signal, the allow-to-travel light signal, and the warn-to-travel light signal may be flexible and can be set according to scene needs.

For one example, the prohibit-to-travel light signal may be a red light signal, where the red light signal may be a twinkle red light signal and/or a non-twinkle red light signal. The non-twinkle red light signal may be simply referred to as a continuous red light signal, and the twinkle red light signal may be simply referred to as a red twinkle light signal. The prohibit-to-travel light signal is a light signal used to indicate to prohibit passing objects (such as vehicles or pedestrians) from travelling. Therefore, any light signal used to indicate to prohibit passing objects (such as vehicles or pedestrians) at corresponding passways from travelling can be regarded as the prohibit-to-travel light signal. The presentation of the prohibit-to-travel light signal is not limited to the above examples. For example, light signals of several colors may also be combined in accordance with certain rules to indicate to prohibit passing objects at corresponding passways from travelling, which can also be regarded as the prohibit-to-travel light signal.

For another example, the allow-to-travel light signal may be a green light signal, where the green light signal may be a twinkle green light signal and/or a non-twinkle green light signal. The non-twinkle green light signal may be simply referred to as a continuous green light signal, and the twinkle green light signal may be simply referred to as a green twinkle light signal. The allow-to-travel light signal is a light signal used to indicate to allow passing objects (such as vehicles or pedestrians) to travel. Therefore, any light signal used to indicate to allow passing objects (such as vehicles or pedestrians) at corresponding passways to travel can be regarded as the allow-to-travel light signal. The presentation of the allow-to-travel light signal is not limited to the above examples. For example, light signals of several colors may also be combined in accordance with certain rules to indicate to allow passing objects at corresponding passways to travel, which can also be regarded as the allow-to-travel light signal.

For still another example, the warn-to-travel light signal may be a yellow light signal, where the yellow light signal may be a twinkle yellow light signal and/or a non-twinkle yellow light signal. The non-twinkle yellow light signal may be simply referred to as a continuous yellow light signal, and the twinkle yellow light signal may be simply referred to as a yellow twinkle light signal. The allow-to-travel light signal is a light signal used to indicate to warn passing objects (such as vehicles or pedestrians) to travel. Therefore, any light signal used to indicate to warn passing objects (such as vehicles or pedestrians) at corresponding passways to travel can be regarded as the warn-to-travel light signal. The presentation of the warn-to-travel light signal is not limited to the above examples. For example, light signals of several colors may also be combined in accordance with certain rules to indicate to warn passing objects at corresponding passways to travel, which can also be regarded as the warn-to-travel light signal.

In conclusion, the allow-to-travel light signal, the prohibit-to-travel light signal, and the warn-to-travel light signal may exist in one or more presentations. However, due to different indication roles of the allow-to-travel light signal, the prohibit-to-travel light signal, and the warn-to-travel light signal, they have different presentations. In other words, there is no intersection between a set of presentations for the allow-to-travel light signal, a set of presentations for the warn-to-travel light signal, and a set of presentations for the prohibit-to-travel light signal.

The warn-to-travel light signal is a light signal used to indicate to warn a passing object (such as a vehicle or a pedestrian, etc.) at a corresponding passway (such as a lane or a crosswalk, etc.). Therefore, from a certain point of view, the warn-to-travel light signal can be seen as a transitional signal (therefore, the warn-to-travel light signal can also be referred to as a transition light signal), indicating that the passing object is transitioning from allow-to-travel to prohibit-to-travel. In some cases, if there is no need for such a transition, there may be no need to keep a transitional signal like the warn-to-travel light signal.

To simplify the description, in the description of some schemes of the present disclosure, a signal light capable of emitting A1 light signal but not capable of emitting A2 light signal and an A3 light signal may be referred to as "A1 signal light". A signal light that can emit A2 light signal but cannot emit A1 light signal and A3 light signal can be called "A2 signal light." A signal light that can emit A3 light signal but cannot emit A1 light signal and A2 light signal can be called "A3 signal light." A signal light capable of emitting A1 light signal and A2 light signal but not capable of emitting A3 light signal may be referred to as "A12 signal light." A signal light that can emit A1 light signal and A3 light signal but cannot emit A2 light signal can be referred to as "A13 signal light." A signal light that can emit A2 light signal and A3 light signal but cannot emit A1 light signal can be called "A23 signal light." A signal light capable of emitting A1 light signal, A2 light signal, and A3 light signal may be referred to as "AA signal light", and so on.

Some related concepts involved in the solution of the implementations of the present disclosure are briefly described above.

In some technical solutions of the implementations of the present disclosure, the intersection traffic light array may be disposed on some or all of the entrance lanes at the plane intersection. The intersection traffic light array on some or all of the entrance lanes may be set in the same or similar way. The following describes the intersection traffic light array in more detail.

An intersection traffic light array is provided, where the intersection traffic light array may include Nxi horizontal ground traffic light sets. The Nxi horizontal ground traffic light sets can include a horizontal ground traffic light set pxi which is disposed at an intersection safety line position of an entrance lane xi of a plane intersection. The Nxi horizontal ground traffic light sets can further include a horizontal ground traffic light set qxi which is disposed at a parking line position of the entrance lane xi.

In one implementation, a lane section defined between an intersection safety line and a stop line of an entrance lane forms an entrance guide area, where the entrance guide area can be an entrance guide area of the entrance lane. For example, a lane section defined between an intersection safety line of the entrance lane xi and a stop line of the entrance lane xi forms an entrance guide area of the entrance lane xi (that is the entrance guide area of the entrance lane xi).

In one implementation, any two horizontal ground traffic light sets among the Nxi horizontal ground traffic light sets can be achieved by the same number of traffic lights or different number of traffic lights, where Nxi is an integer greater than 1. Each horizontal ground traffic light set among the Nxi horizontal ground traffic light sets may include at least one traffic light (such as one traffic light or two traffic lights).

In one implementation, Nxi may be equal to 2, 3, 5, 7, 8, 10, 11, 29, 36, 50, 100 and so on.

As an example, at least one traffic light (such as one traffic light or at least two traffic lights) of a horizontal ground traffic light set i have a wireless driving signal input port and/or a wired driving signal input port. The horizontal ground traffic light set i is one of the Nxi horizontal ground traffic light sets or any one of the Nxi horizontal ground traffic light sets.

In one implementation, a distance between any two adjacent horizontal ground traffic light set among the Nxi horizontal ground traffic light sets is equal or partially equal or not equal to each other. For example, the distance between any two adjacent horizontal ground traffic light set among the Nxi horizontal ground traffic light sets can be 1 meter, 1.5 meters, 2 meters, 2.5 meters, 3 meters, or other values. For another example, among the Nxi transverse ground traffic light groups, the farther the horizontal ground traffic light set pxi is from (that is, in a driving direction of the entrance lane xi, the distance between two adjacent horizontal ground traffic light sets gradually increases), the smaller the distance between two adjacent horizontal ground traffic light sets is. Or, among the Nxi transverse ground traffic light groups, the closer the horizontal ground traffic light set pxi is to (in other words, in the driving direction of the entrance lane xi, the distance between two adjacent horizontal ground traffic light sets gradually decreases), the larger the distance between two adjacent horizontal ground traffic light sets is. In other implementations, the distance between the two adjacent horizontal ground traffic light sets among the Nxi horizontal ground traffic light sets may also be randomly changed or have other variation scheme, and may not necessarily exhibit the above-mentioned scheme that gradually decrease or gradually increase in a certain direction.

For example, the distance between two adjacent horizontal ground traffic light sets, among the Nxi horizontal ground traffic light sets, which is disposed at the entrance guide area can be equal. An interval of starting time of allow-to-travel light signals (or prohibit-to-travel light signals, or warn-to-travel light signals) emitted by the two adjacent horizontal ground traffic light sets among the Nxi horizontal ground traffic light sets may also be equal. As such, this mode can be called "equal distance equal time mode". In some scenarios, the distance between two adjacent horizontal ground traffic light sets, among the Nxi horizontal ground traffic light sets, which is disposed at the entrance guide area is equal; but the interval of starting time of allow-to-travel light signals (or prohibit-to-travel light signals, or warn-to-travel light signals) emitted by the two adjacent horizontal ground traffic light sets among the Nxi horizontal ground traffic light sets is not equal, and therefore this mode can be called "equal distance and not equal time mode". In some scenarios, the distance between two adjacent horizontal ground traffic light sets, among the Nxi horizontal ground traffic light sets, which is disposed at the entrance guide area is not equal; but the interval of starting time of allow-to-travel light signals (or prohibit-to-travel light signals, or warn-to-travel light signals) emitted by the two adjacent horizontal ground traffic light sets among the Nxi horizontal ground traffic light sets is equal, and therefore this mode can be called "equal time and not equal distance mode". Further, "not equal time and not equal distance mode" can be achieved in the above manner.

In particular, when Nxi is equal to 11 and the length of the entrance guide area of the entrance lane xi is 10 meters, the Nxi horizontal ground traffic light sets can be evenly divided between the intersection safety line and the stop line of the entrance lane xi. For example, in the entrance guide area of the entrance lane xi, a horizontal ground traffic light set is arranged every 1 meter, and the Nxi horizontal ground traffic light sets divide the entrance guide area of the entrance lane xi into 10 entrance lanes, and a distance between any two adjacent horizontal ground traffic light sets is 1 meter. An interval of the starting time of allow-to-travel light signals (or prohibit-to-travel light signals or warn-to-travel light signals) emitted by any two adjacent horizontal ground traffic light sets may be equal (such as, 0.2 second, 1 second, 1.5 second, or 2 second, etc.), or may be not equal. In one implementation, when Nxi is equal to 6 and the length of the entrance guide area of the entrance lane xi is 10 meters, the Nxi horizontal ground traffic light sets can be evenly divided between the intersection safety line and the stop line of the entrance lane xi. For example, in the entrance guide area of the entrance lane xi, a horizontal ground traffic light set is arranged every 2 meters, and the Nxi horizontal ground traffic light sets divide the entrance guide area of the entrance lane xi into 5 entrance lanes, and a distance between any two adjacent horizontal ground traffic light sets is 2 meters. The interval of the starting time of the allow-to-travel light signals (or the prohibit-to-travel light signals or the warn-to-travel light signals) emitted by any two adjacent horizontal ground traffic light sets may be equal or may be not equal. In addition, other setting methods with equal distance between two adjacent horizontal ground traffic light sets among the Nxi horizontal ground traffic light sets can be achieved in the above manner.

When the horizontal ground traffic light set i includes at least two traffic lights, the at least two traffic lights of the horizontal ground traffic light set i share the same driving signal, or use different driving signals.

It is to be noted that operating states of several traffic lights sharing the same driving signal are synchronously changed; for example, the several traffic lights sharing the same driving signal will be simultaneously lit up or simultaneously turned off, because these traffic lights are collectively driven and controlled by the same driving signal. Operating states of two traffic lights using different driving signals may not be changed synchronically or may be changed synchronically. In general, the operating states of the traffic lights using the same driving signal output from the same driving signal output port (the driving signal output port may refer to a driving signal output port of an array driver or a traffic signal, etc.) are changed synchronously with a specific condition that timing of the driving signal output from the driving signal output port is not changed during the arrival of the signal light from the driving signal output port. In general, the operating states of the traffic lights using the driving signals output from different driving signal output ports may not be synchronously changed, or may also be synchronously changed.

The entrance lane xi may be one of entrance lanes of the plane intersection, or the entrance lane xi can be any entrance lane of the plane intersection. That is, part or all of the entrance lanes of the plane intersection can be deployed with horizontal ground traffic light sets in the same or similar manner as the entrance lane xi deployed.

It is to be noted that since the traffic lights of the horizontal ground traffic light sets are set on the ground, these traffic lights can also be called ground traffic lights (also referred to as "ground lights"). Unless otherwise specified, the traffic lights of the horizontal ground traffic light sets mentioned in the implementations of the present application are the ground traffic lights. It can be understood that since the ground traffic lights are disposed on the ground, the ground traffic lights are different from high-altitude traffic lights in terms of way of setting up and product modality. The high-altitude traffic lights may include, for example, a pillar traffic light or a cantilever type traffic light.

It can be understood that the "transverse" in the horizontal ground traffic light set is intended to indicate that the length direction of the horizontal ground traffic light set and the driving direction of the corresponding lane are vertical or substantially vertical, at least the length direction of the horizontal ground traffic light set and the driving direction of the corresponding lane are not parallel, and the range of an angle between the length direction of the horizontal ground traffic light set and the driving direction of the corresponding lane may be greater than or equal to 45° and less than or equal to 90°, for example, the angle may be equal to 90°, 89°, 85°, 80°, 78°, 75°, 60°, 53°, or 40°. In addition, the range of the angle between the length direction of the horizontal ground traffic light set and the driving direction of the corresponding lane is not limited to the above example.

In one implementation, when Nxi is an integer greater than 2, the Nxi horizontal ground traffic light sets further include Nxi−2 horizontal ground traffic light sets which are disposed at between an intersection safety line and a stop line of the entrance lane xi. It can be understood that the Nxi−2 (e.g., Nxi=6, then Nxi-2=6−2=4, and so on) horizontal ground traffic light sets may include part or all of the horizontal ground traffic light sets which are disposed at between the intersection safety line and the stop line of the entrance lane xi.

In the implementation, the intersection traffic light array can include Nxi horizontal ground traffic light sets; the Nxi horizontal ground traffic light sets include a horizontal ground traffic light set pxi which is disposed at an intersection safety line position of an entrance lane xi of a plane intersection, and a horizontal ground traffic light set qxi which is disposed at a stop line position of the entrance lane xi. Since a lane section defined between an intersection safety line and a stop line of an entrance lane xi can form an entrance guide area, which provides a certain space basis for the vehicle to accelerate in advance to pass through the intersection, and provides a certain basis to control the speed for the vehicle to enter the intersection (i.e., the speed at which the vehicle exits the entrance guide area) and the driving state of the vehicle in the entrance guide area, which in turn makes it possible to improve the traffic efficiency of the vehicle at the intersection. For example, the Nxi horizontal ground traffic light sets can divide the entrance guide area into several lanes, and the light signals emitted by the Nxi horizontal ground traffic light sets can be used to make it possible that the driving state of the vehicle in the entrance guide area and the speed at which the vehicle exits the entrance guide area can be controlled precisely, such that it is beneficial to improve the safety and controllability of vehicle traffic at the intersections. In addition, the ground-based traffic light set is more convenient for the driver to recognize the corresponding traffic control signal, thereby further improving the safety and controllability of the vehicle traffic at the intersection.

Figure 3:
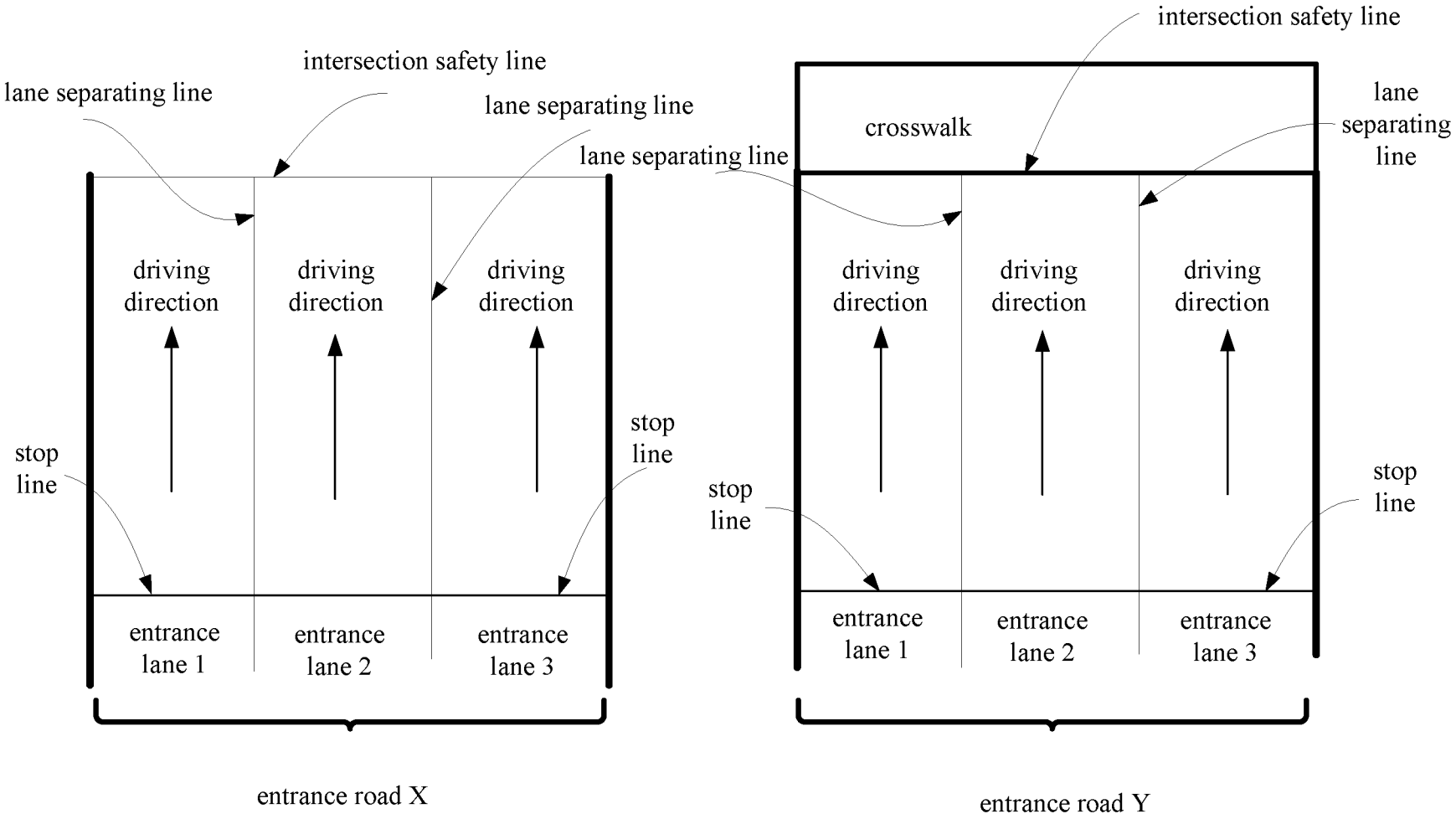
FIG. 3 is a schematic diagram illustrating layouts of two types of an entrance road according to an implementation of the present disclosure.

The following description is made with reference to the drawings. Referring to FIG. 3, FIG. 3 illustrates road conditions of an entrance road before setting a transverse ground traffic light group. An entrance road (an entrance road X) exemplified by the left part of FIG. 3 and an entrance road (an entrance road Y) exemplified by the right part include three entrance lanes respectively. The condition that the entrance road includes other numbers of entrance lanes can be similar to the above mentioned. As illustrated in the right part of FIG. 3, there has a pedestrian crossing in front of the entrance road Y, and there has no pedestrian crossing in front of the entrance road X illustrated in the left part of FIG. 3.

Figure 4A:
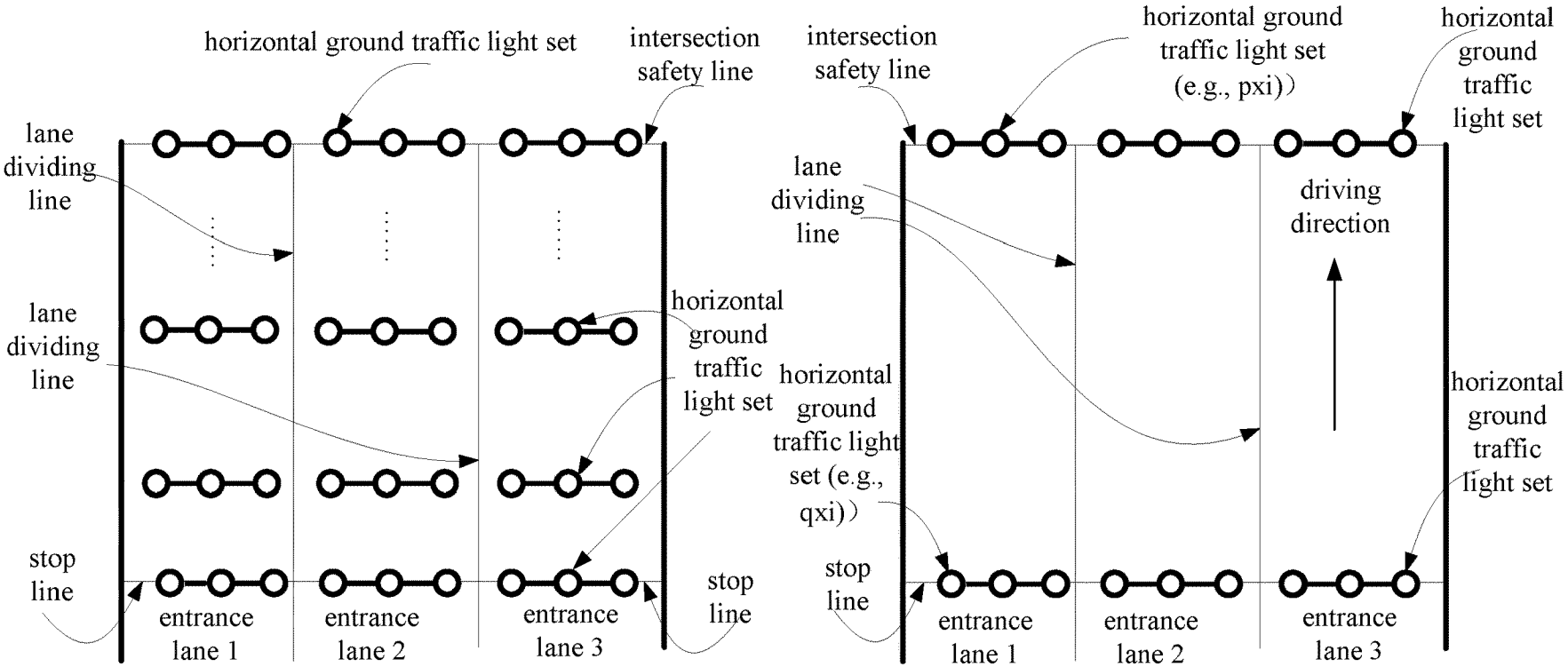
FIGS. 4A-4C are schematic diagrams illustrating layouts of several types of an intersection traffic light array according to implementations of the present disclosure.
Figure 4B:
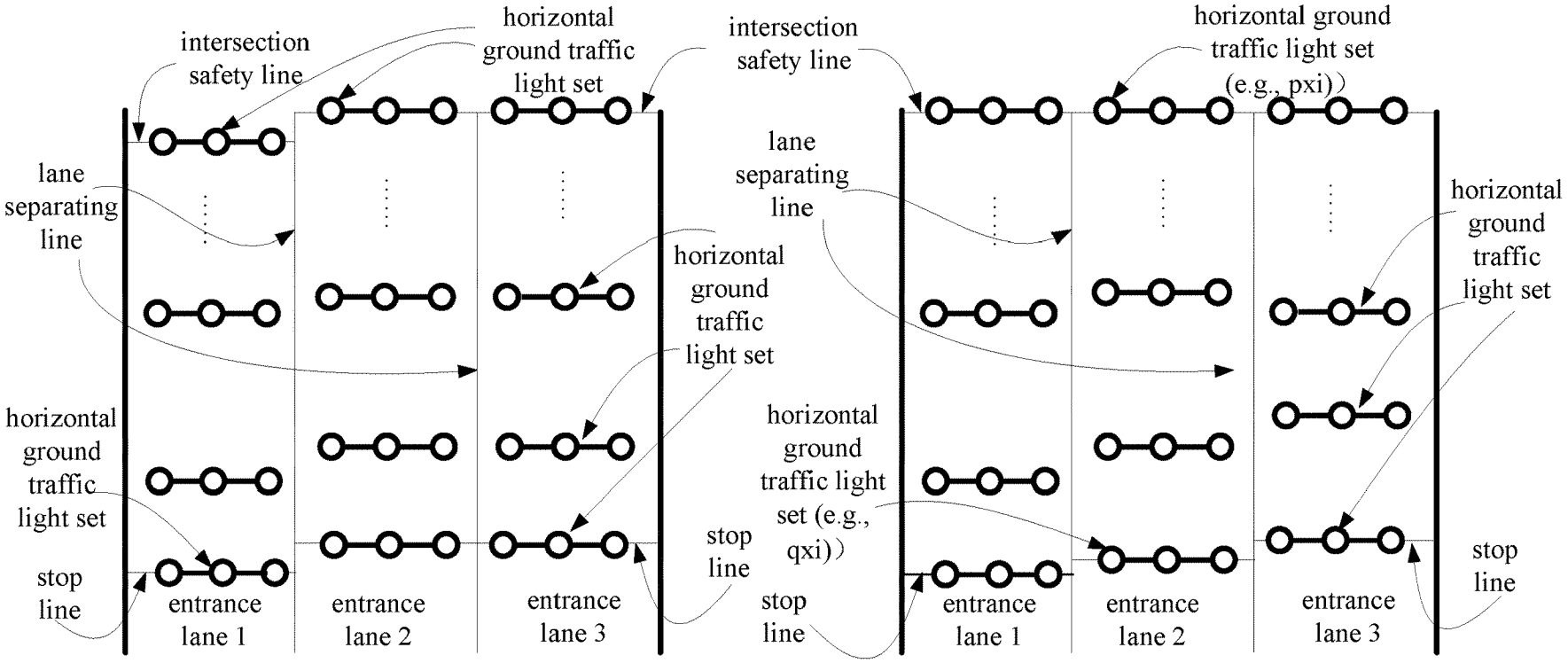
Figure 4C:
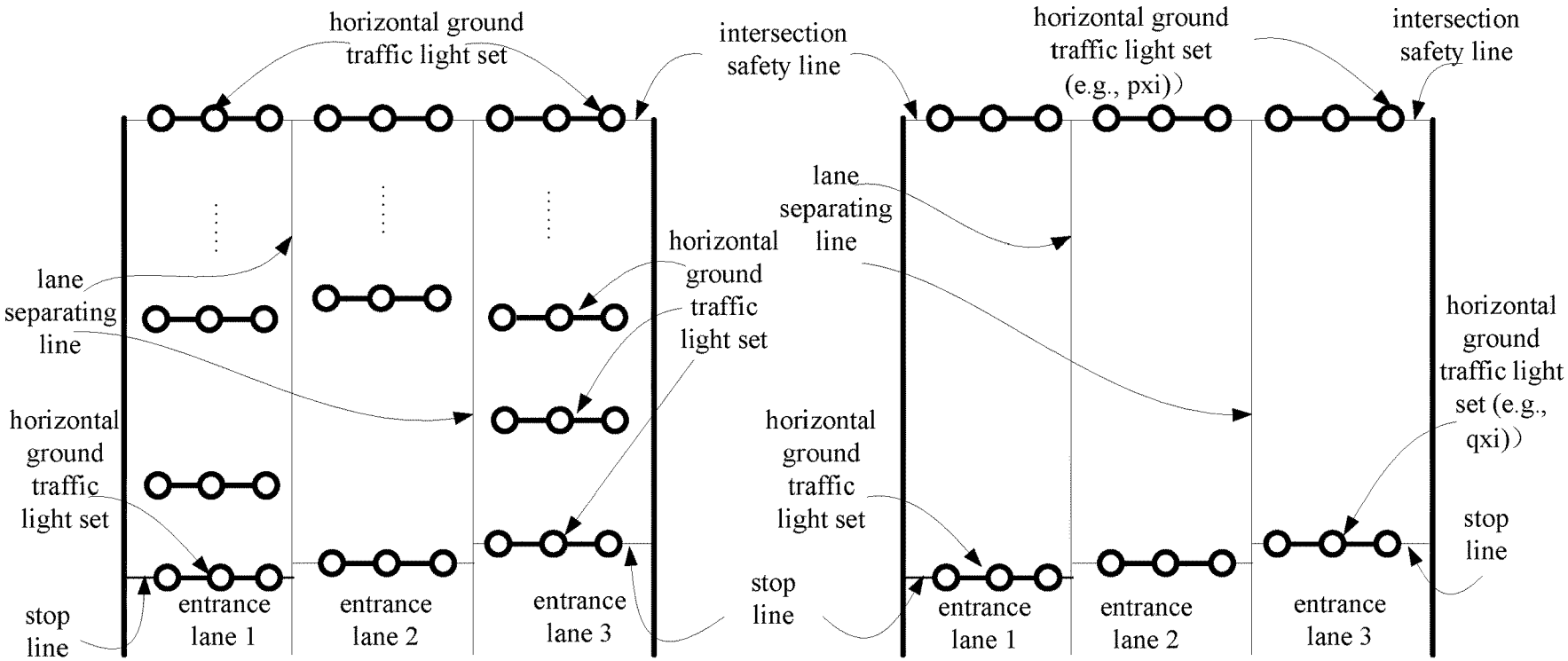

Referring to FIG. 4A to FIG. 4C, FIGS. 4A to 4C illustrate several possible road conditions after setting a horizontal ground traffic light set on an entrance lane with no pedestrian crossing ahead. FIG. 4A illustrates an example where the horizontal ground traffic light sets at the corresponding positions set on each entrance road of the entrance roads in the illustrated scene are basically located on the same straight line. In the scenario illustrated in FIG. 4B, the horizontal ground traffic light sets at corresponding positions set on the part of the entrance lanes of the same entrance road are basically on the same straight line, and the horizontal ground traffic light sets at corresponding positions set on the other part of the entrance lanes are basically on the same straight line. Further, on the same entrance road, there are some stop lines in the entrance lanes and other stop lines in the entrance lane may not be on the same straight line.

For the example of the left part of FIG. 4A and FIG. 4B, Nxi is equal to 4 as an example (i.e., at least 4 horizontal ground traffic light sets are set on each entrance lane). Among them, in the example of the right parts of FIG. 4A and FIG. 4C, for each entrance lane, Nxi is equal to 2 as an example. The case where Nxi equals other values can be obtained in the above manner.

It is to be noted that the number of horizontal ground traffic light sets provided on each entrance lane of the same entrance road may be equal or not equal. The number of horizontal ground traffic light sets provided on the entrance lanes of different entrance roads may be equal or not equal.

In some possible implementations, a traffic light ia among the horizontal ground traffic light set i can emit a prohibit-to-travel light signal under the driving of a first driving signal, and the traffic light ia can also be emitted an allow-to-travel light signal under the driving of a second driving signal. The traffic light ia can be, for example, an A12 traffic lights. Alternatively, the traffic light ia among the horizontal ground traffic light set i can emit a prohibit-to-travel light signal under the driving the first driving signal, the traffic light ia can also emit an allow-to-travel light signal under the driving of the second driving signal, and the traffic light ia can also emit a warn-to-travel light signal under the driving of a third driving signal, where the traffic lights ia can be, for example, an AA traffic light. The traffic light ia can be one or any one of the traffic light among the horizontal ground traffic light sets. That is, in some possible implementations of the present application, a single traffic light can emit different light signals under the driving of different driving signals. Specifically, for example, part or all of the traffic lights among the ground traffic light set i can emit red light signals under the driving of the first driving signal, and part or all of the traffic lights among the ground traffic light set i can emit green light signals under the driving of the second driving signals. In addition, part or all of the traffic lights among the ground traffic light set i can emit yellow light signals under the driving of the third driving signal.

In some possible implementations, i1 traffic lights among the horizontal ground traffic light set i are traffic lights capable of emitting a prohibit-to-travel light signal, and i2 traffic lights among the horizontal ground traffic light set i are traffic lights capable of emitting an allow-to-travel light signal. In one implementation, the i1 traffic lights among the horizontal ground traffic light set i are traffic lights capable of emitting a prohibit-to-travel light signal, the i2 traffic lights among the horizontal ground traffic light set i are traffic lights capable of emitting an allow-to-travel light signal, and i3 traffic lights among the horizontal ground traffic light set i are traffic lights capable of emitting a warn-to-travel light signal.

In one implementation, i1, i2, and i3 are integers greater than 1.

For example, i1 may be equal to 1, 2, 3, 4, 7, 9, 10, 11, 29, 36, 50, 100, or other values.

For example, i2 may be equal to 1, 2, 3, 5, 7, 8, 10, 11, 29, 36, 50, 100, or other values for example.

For example, i3 may be equal to 1, 2, 3, 6, 7, 8, 4, 11, 29, 36, 50, 100, or other values.

In particular, the above i1 traffic lights can emit a prohibit-to-travel light signal, but the above i1 traffic lights cannot emit an allow-to-travel light signal and/or a warn-to-travel light signal. Therefore, the above i1 traffic lights may be traffic lights dedicated to emitting the prohibit-to-travel light signal, and the i1 traffic lights may be A1 type traffic lights. For another example, the above i2 traffic lights can emit an allow-to-travel light signal, but the above i2 traffic lights cannot emit a prohibit-to-travel light signal and/or a warn-to-travel light signal. Therefore, the above i2 traffic lights may be traffic lights dedicated to emitting the allow-to-travel light signal, and the above i2 traffic lights may be A2 traffic lights. For another example, the above i3 traffic lights can emit a warn-to-travel light signal, but the above i3 traffic lights cannot emit an allow-to-travel light signal and/or a prohibit-to-travel light signal. Therefore, the above i3 traffic lights may be traffic lights dedicated to emitting a warn-to-travel light signal, the i3 traffic lights may be A3 traffic lights.

It is to be noted that even a single traffic light may only emit one kind of light signal (such as a warn-to-travel light signal, an allow-to-travel light signal, or a prohibit-to-travel light signal). However, when a single horizontal ground traffic light set includes at least one (for example, one or at least two) A1 type traffic light, and further includes at least one (e.g. one or at least two) A2 type traffic light. Or when a single horizontal ground traffic light set includes at least one (e.g. one or at least two) A1 traffic lights, further includes at least one (for example, one or at least two) A2 traffic lights, and further includes at least one (for example, one or at least two) A3 traffic lights. In this case, if these three types of traffic lights among a single horizontal ground traffic light set (such as A1 traffic lights, A2 traffic lights, and A3 traffic lights) are not lit up at the same time (that is, they are not working at the same time), the horizontal ground traffic light set (such as the horizontal ground traffic light set xi) may generally still present a unified light signal for indicating whether to allow, prohibit, or warn the passing objects (such as vehicles or pedestrians, etc.) to pass at the corresponding lane.

In some possible implementations, the traffic light ia among the horizontal ground traffic light set i can emit a prohibit-to-travel light signal and traffic light ib among the horizontal ground traffic light set i can emit an allow-to-travel light signal. The traffic light ia and the traffic light ib are two adjacent traffic lights among the horizontal ground traffic light set i, or the traffic light ia and the traffic light ib are any two adjacent traffic lights among the horizontal ground traffic light set i. The traffic light ia among the horizontal ground traffic light set i can emit a prohibit-to-travel light signal, and the traffic light ib among the horizontal ground traffic light set i can emit an allow-to-travel light signal, and the traffic light ic among the horizontal ground traffic light set i can emit a warn-to-travel light signal. The traffic light ia, the traffic light ib, and the traffic light ic are three adjacent traffic lights among the horizontal ground traffic light set i; or the traffic light ia, the traffic light ib, and the traffic light ic are any three adjacent traffic lights among the horizontal ground traffic light set i.

For example, the traffic light ia is an A1 type traffic light, the traffic light ib is an A2 type traffic light, and the traffic light ic is an A3 type traffic light. In other words, the traffic lights, included in the horizontal ground traffic light set, capable of emitting different light signals may be interspersed with each other. Specifically, the distribution areas of the traffic lights, included in the horizontal ground traffic light set, capable of emitting different light signals may partially or entirely overlap. That is, the traffic lights, included in the horizontal ground traffic light set, capable of emitting different light signals are relatively evenly distributed in the distribution area of the horizontal ground traffic light set.

In some possible implementations, part or all of the traffic lights among the horizontal ground traffic light set i may be partially or completely buried under the road surface. Or part or all of the traffic lights among the horizontal ground traffic light set i may be mounted on the road surface. In other words, part or all of the lamp body of the traffic lights among the horizontal ground traffic light set may protrude from the ground or may not protrude from the ground at all.

In some implementations, part or all of the traffic lights of the horizontal ground traffic light set i are track spikes, light bars (such as LED light bars), or graphene lights. In addition, the product modality of the traffic lights among the horizontal ground traffic light set is not limited to the above example. For example, the traffic light is among the horizontal ground traffic light set i may include: V lamp beads, a circuit board for driving the V lamp beads to work, and a housing for receiving the V lamp beads and the circuit Board. The circuit board has a wired driving signal input port and/or a wireless driving signal input port. V is an integer greater than or equal to 1. Here, V may be equal to 1, 2, 3, 5, 7, 8, 10, 21, 29, 36, 50, 100, or other values. For example, the V lamp beads may include: v1 lamp beads capable of emitting a prohibit-to-travel light signal, v2 lamp beads capable of emitting an allow-to-travel light signal, and/or v3 lamp beads capable of emitting a warn-to-travel light signal, where v1, v2, and v3 are integers greater than or equal to 1.

In some possible implementations, two horizontal ground traffic light sets among the Nxi horizontal ground traffic light sets can start to emit a prohibit-to-travel light signal, an allow-to-travel light signal, or a warn-to-travel light signal at different starting time. Alternatively, any two horizontal ground traffic light sets among the Nxi horizontal ground traffic light sets can start to emit a prohibit-to-travel light signal, an allow-to-travel light signal, or a warn-to-travel light signal at different starting time. Alternatively, two horizontal ground traffic light sets among the Nxi horizontal ground traffic light sets can start to emit a prohibit-to-travel light signal, an allow-to-travel light signal, or a warn-to-travel light signal at the same starting time. Alternatively, any two horizontal ground traffic light sets among the Nxi horizontal ground traffic light sets can start to emit a prohibit-to-travel light signal, an allow-to-travel light signal, or a warn-to-travel light signal at the same starting time.

In some possible implementations, the closer a distance between a horizontal ground traffic light set among the Nxi horizontal ground traffic light sets and the horizontal ground traffic light set qxi is, the earlier a starting time when the horizontal ground traffic light set emits a prohibit-to-travel light signal (or an allow-to-travel light signal or a warn-to-travel light signal) is. A starting time of a prohibit-to-travel light signal (or an allow-to-travel light signal or a warn-to-travel light signal) emitted by the horizontal ground traffic light set pxi is later than that emitted by any horizontal ground traffic light set among the Nxi horizontal ground traffic light sets. Assuming that the Nxi horizontal ground traffic light sets includes a horizontal ground traffic light set j1, a horizontal ground traffic light set j2, and a horizontal ground traffic light set j3, where j1, j2, and j3 are three (such as three or any three) adjacent horizontal ground traffic light sets among the Nxi horizontal ground traffic light sets. A distance between the horizontal ground traffic light set j2 and the stop line of the entrance lane xi is greater than that between the horizontal ground traffic light set j1 and the stop line of the entrance lane xi. A distance between the horizontal ground traffic light set j2 and the stop line of the entrance lane xi is less than that between the horizontal ground traffic light set j3 and the stop line of the entrance lane xi.

The horizontal ground traffic light set j1 may be the horizontal ground traffic light set qxi, or may be a horizontal ground traffic light set which is disposed at an intersection safety line and a stop line of an entrance lane xi. The horizontal ground traffic light set j3 may be the horizontal ground traffic light set pxi, or may be the horizontal ground traffic light set which is disposed at an intersection safety line and a stop line of an entrance lane xi.

In some possible implementations, a quotient $V_{j1_j}2$ is obtained through which the distance between the horizontal ground traffic light set j2 and the horizontal ground traffic light set j1 is divided by the time difference of starting time of an allow-to-travel light signal (or a prohibit-to-travel light signal or a warn-to-travel light signal) emitted by the horizontal ground traffic light set j2 and starting time of an allow-to-travel light signal emitted by the horizontal ground traffic light set j1. A quotient $V_{j2_j3}$ is obtained through which the distance between the horizontal ground traffic light set j2 and the horizontal ground traffic light set j3 is divided by the time difference of starting time of an allow-to-travel light signal (or a prohibit-to-travel light signal or a warn-to-travel light signal) emitted by the horizontal ground traffic light set j2 and starting time of an allow-to-travel light signal emitted by the horizontal ground traffic light set j3. For example, the quotient $V_{j1_j2}$ may be less than the quotient $V_{j2_j3}$.

It is to be noted that when the $V_{j1_j2}$ is equal to the $V_{j2_j3}$, guide speed presented when the horizontal ground traffic light sets j1, the horizontal ground traffic light sets j2, and the horizontal ground traffic light sets j3 can sequentially emit to the allow-to-travel light signal (or the prohibit-to-travel light signal or the warn-to-travel light signal) is constant guide speed. When the $V_{j1_j2}$ is less than the $V_{j2_j3}$, guide speed presented when the horizontal ground traffic light sets j1, the horizontal ground traffic light sets j2, and the horizontal ground traffic light sets j3 can sequentially emit to the allow-to-travel light signal (or the prohibit-to-travel light signal or the warn-to-travel light signal) is uniform or non-uniform acceleration.

It is to be noted that, guide speed presented when the Nxi horizontal ground traffic light sets are driven to emit the allow-to-travel light signal sequentially from the horizontal ground traffic light set qxi is constant guide speed, or uniform or non-uniform acceleration variable guide speed, which help to safely guide the speed of the vehicle at the entrance guide area.

When the horizontal ground traffic light set qxi emits an allow-to-travel light signal, it indicates that the vehicle on the current entrance lane xi is permitted to pass through the horizontal ground traffic light set qxi (i.e., allowing the vehicles on the entrance lane xi to pass through the stop line of the entrance lane xi). After the vehicle (for example, the head car stopped behind the horizontal ground traffic light set qxi) enters the entrance guide area, the vehicle gradually passes through a horizontal ground traffic light set other than the horizontal ground traffic light set pxi among the Nxi horizontal ground traffic light sets under the guidance of the allow-to-travel light signal emitted by the horizontal ground traffic light set. Then the vehicle gradually passes though the horizontal ground traffic light set pxi (that is passing through the intersection safety line of the entrance lane xi) under the guidance of the allow-to-travel light signal emitted by the horizontal ground traffic light set pxi. After passing the horizontal ground traffic light set pxi, the vehicle enters the intersection or enters the intersection after crossing the pedestrian crossing, and the vehicle eventually crosses the intersection into the corresponding downstream lane. In general, under the guidance of guide speed (the guide speed may be constant guide speed or variable guide speed) presented when the Nxi horizontal ground traffic light sets emit the allow-to-travel light signal sequentially from the horizontal ground traffic light set qxi, the vehicle will pass the entrance guide area at a speed less than or equal to this guide speed. Before the horizontal ground traffic light set pxi emits an allow-to-travel light signal, if the vehicle travels in the entrance guide area at a speed greater than the corresponding guide speed, it is very likely that the vehicle will run a red light. That is, it is likely that the vehicle will pass a horizontal ground traffic light set before the horizontal ground traffic light set emits an allow-to-travel light signal (the horizontal ground traffic light set can be in an off state or in a state of emitting a prohibit-to-travel light signal before emitting an allow-to-travel light signal), which is very unsafe.

It can be seen that the use of Nxi horizontal ground traffic light sets is conducive to safely guide the vehicle's driving speed in the entrance guide area, so as to make vehicles enter the intersection at a safer speed. Therefore, the efficiency of vehicles passing the intersection can be improved, and the safety of vehicles passing the intersection can be ensured. In other words, the solution of the implementation of the present application is conducive to a balance between the efficiency and safety of the vehicle passing the intersection.

A driving control method for an intersection traffic light array is provided. The intersection traffic light array can be any intersection traffic light array described above. The intersection traffic light array can include Nxi horizontal ground traffic light sets. The Nxi horizontal ground traffic light sets include a horizontal ground traffic light set pxi which is disposed at an intersection safety line position of an entrance lane xi of a plane intersection. The Nxi horizontal ground traffic light sets further include a horizontal ground traffic light set qxi which is disposed at a stop line position of the entrance lane xi. Each horizontal ground traffic light set among the Nxi horizontal ground traffic light sets includes at least one (such as one or at least two) traffic light, and part or all of traffic lights of a horizontal ground traffic light set i have at least one of a wireless driving signal input port and a wired driving signal input port. The horizontal ground traffic light set i is one or any one of the Nxi horizontal ground traffic light sets.

When the horizontal ground traffic light set i includes at least two traffic lights, the at least two traffic lights of the horizontal ground traffic light set i can share the same driving signal; or any two traffic lights of the horizontal ground traffic light set i can share different driving signal.

A driving control method for an intersection traffic light array may include: driving the Nxi horizontal ground traffic light sets to emit an allow-to-travel light signal sequentially from the horizontal ground traffic light set qxi when there is an overlap time length $T_{cd_xi}$ left to the end of a conflict control phase at the last intersection of a control phase of the entrance lane xi. The closer a distance between a horizontal ground traffic light set among the Nxi horizontal ground traffic light sets and the horizontal ground traffic light set qxi is, the earlier a starting time when the horizontal ground traffic light set is driven to emit the allow-to-travel light signal is. A starting time of an allow-to-travel light signal emitted by driving the horizontal ground traffic light set pxi is later than that emitted by driving any horizontal ground traffic light set among the Nxi horizontal ground traffic light sets. For example, by detecting (directly or indirectly detecting) the progress of a conflict control phase of the last intersection of a control phase of the entrance lane xi, it is possible to learn the time when there is an overlap time length $T_{cd_xi}$ left to the end of the conflict control phase of the last intersection of the control phase of the entrance lane xi.

It is to be noted that the overlap time length corresponding to the entrance lanes with different driving directions at the same plane intersection may be equal, partially equal, or not equal to each other. The overlap time lengths corresponding to the entrance lanes with the same driving direction but different guide at the same plane intersection may be equal, partially equal, or not equal to each other. The overlap time length corresponding to the entrance lanes with the same driving direction and the same guide at the same plane intersection may be equal, partially equal, not equal to each other. It can be understood that the overlap time length $T_{cd_xi}$ is an overlap time length corresponding to the entrance lane xi, and the entrance lane xi is one or any one of entrance lanes of the plane intersection.

The starting time of the allow-to-travel light signal emitted by the horizontal ground traffic light set pxi is an ending time of the conflict control phase at the last intersection. That is, an interval $T_{\Delta_pxi_qxi}$ of the starting time of the allow-to-travel light signal emitted by the horizontal ground traffic light set pxi and an allow-to-travel light signal emitted by the horizontal ground traffic light set qxi is equal to the overlap time length $T_{cd_xi}$. The overlap time length $T_{cd_xi}$ may be a stored preset value (the currently stored $T_{cd_xi}$ may be updated according to an overlap time length update instruction from a host device or a human-machine interface) or the overlap time length $T_{cd_xi}$ may be calculated in real time based on a preset scheme. For example, the overlap time length $T_{cd_xi}$ may be equal to 2 seconds, 3 seconds, 4 seconds, 5 seconds, 6 seconds, 7 seconds, 8.1 seconds, 10 seconds and so on.

For example, assuming that the entrance lane xi is an eastbound straight lane, a last intersection conflict control phase of the control phase of the entrance lane xi may be, for example, a control phase of a southbound straight lane, a northbound straight lane, a westbound left-turn lane, or an northbound left-turn lane of the plane intersection, because the eastbound straight lane of the plane intersection, and the southbound straight lane, the northbound straight lane, the westbound left-turn lane, or the northbound left-turn lane of the plane intersection are conflict lanes. Also assuming that the entrance lane xi is a westbound straight lane, and the last intersection conflict control phase of the control phase of the entrance lane xi may be, for example, a control phase of a southbound straight lane, a northbound straight lane, an eastbound left-turn lane, or a southbound left-turn lane of the plane intersection, because the westbound straight lane of the plane intersection, and the southbound straight lane, the northbound straight lane, the eastbound left-turn lane, or the southbound left-turn lane of the plane intersection are conflict lanes. In addition, other conflicts can be obtained in the above manner.

Figure 5A:
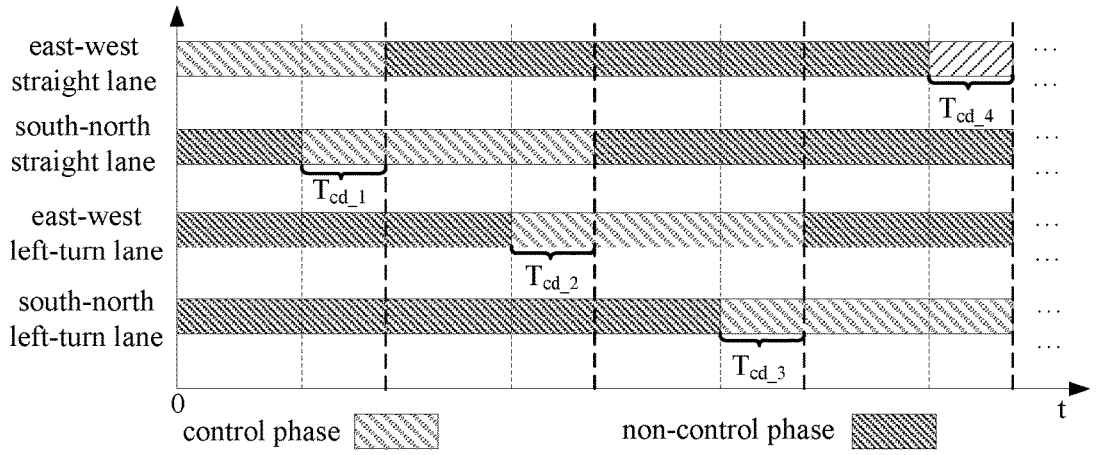
FIGS. 5A-5D are schematic diagrams illustrating phase cycles of several entrance lanes according to implementations of the present disclosure.

For example, in the scenario illustrated in the FIG. 5A, control phases of a north-south left-turn lane, a west-east left-turn lane, a north-south straight lane, and a west-east straight lane are cycled. The last intersection conflict control phase of the control phase of the north-south left-turn lane is the control phase of the west-east left-turn lane. The last intersection conflict control phase of the control phase of the west-east left-turn lane is the control phase of the north-south straight lane. The last intersection conflict control phase of the control phase of the north-south straight lane is the control phase of the west-east straight lane. In the scenario illustrated in the FIG. 5A, assuming that the entrance lane xi is an entrance lane in a north-south left-turn lane, the last intersection conflict control phase of the control phase of the entrance lane xi is a control phase of the west-east left-turn lane. Also, assuming that the entrance lane xi is an entrance lane in the east-west left-turn lane, the last intersection conflict control phase of the control lane of the entrance lane xi is a control phase of the north-south straight lane.

In the scenario illustrated in the FIG. 5A, an overlap time length of the control phases of a north-south left-turn lane and a west-east left-turn lane is $T_{cd_3}$. An overlap time length of the control phases of a west-east left-turn lane and a north-south straight lane is $T_{cd_2}$. An overlap time length of the control phases of a north-south straight lane and a west-east straight lane is $T_{cd_1}$. An overlap time length of the control phases of a west-east straight lane and a north-south left-turn lane is $T_{cd_4}$. $T_{cd_1}$, $T_{cd_2}$, $T_{cd_3}$, and $T_{cd_4}$ may all be equal, partially equal, or not equal to each other.

It can be seen that since a lane section defined between an intersection safety line and a stop line of an entrance lane xi can form an entrance guide area, which provides a certain space basis for the vehicle to accelerate in advance to pass through the intersection, and provides a certain basis to control the speed for the vehicle to enter the intersection (i.e., the speed at which the vehicle exits the entrance guide area) and the driving state of the vehicle in the entrance guide area, which in turn makes it possible to improve the traffic efficiency of the vehicle at the intersection. For example, the Nxi horizontal ground traffic light sets can divide the entrance guide area into several lanes, and the light signals emitted by the Nxi horizontal ground traffic light sets can be used to make it possible that the driving state of the vehicle in the entrance guide area and the speed at which the vehicle exits the entrance guide area can be controlled precisely, such that it is beneficial to improve the safety and controllability of vehicle traffic at the intersections. In addition, the ground-based traffic light set is more convenient for the driver to recognize the corresponding traffic control signal, thereby further improving the safety and controllability of the vehicle traffic at the intersection. Specifically, by flexibly controlling the starting time of an allow-to-travel light signal, a warn-to-travel light signal, or a prohibit-to-travel light signal emitted by each transverse ground traffic light among the Nxi horizontal ground traffic light sets, it is beneficial to accurately control the time and speed that the vehicle passes through the intersection, so that the safety and controllability of vehicle traffic at the intersection can be further improved. For example, the Nxi horizontal ground traffic light sets are driven to emit an allow-to-travel light signal sequentially from the horizontal ground traffic light set qxi when there is an overlap time length $T_{cd_xi}$ left to the end of a last intersection conflict control phase of a control phase of the entrance lane xi. The closer a distance between a horizontal ground traffic light set among the Nxi s and the horizontal ground traffic light set qxi is, and the earlier a starting time when the horizontal ground traffic light set is driven to emit the allow-to-travel light signal is, which can be considered that each horizontal ground traffic light set among the Nxi horizontal ground traffic light sets emits the allow-to-travel light signal in a certain order. Therefore, this lays the foundation of a reasonable and appropriate guidance for the time and the speed for the vehicle passing through the entrance guide area. For example, it helps the vehicle to safely and controllably drive out of the entrance guidance area under the guidance of the guide speed presented by the light signals emitted by the Nxi horizontal ground traffic light sets, thereby facilitating the vehicle to pass through the intersection in a safe, controllable, and efficient manner.

In practical applications, guide speed presented when the Nxi horizontal ground traffic light sets are driven to emit the allow-to-travel light signal sequentially from the horizontal ground traffic light set qxi is constant guide speed or variable guide speed. The variable guide speed can be a uniform acceleration guide speed (where the uniform acceleration guide speed may include a uniform acceleration guide speed with the initial speed equal to zero and a uniform acceleration guide speed with the initial speed not equal to zero) or a non-uniform acceleration guide speed.

In the case that the guide speed presented when the Nxi horizontal ground traffic light sets are driven to emit the allow-to-travel light signal sequentially from the horizontal ground traffic light set qxi is constant guide speed, an interval length $T_{\Delta g_i_qxi}$ of a starting time of an allow-to-travel light signal emitted by the horizontal ground traffic light set i, among the Nxi horizontal ground traffic light sets, relative to the starting time of the allow-to-travel light signal emitted by the horizontal ground traffic light set qxi is expressed as $$T_{\Delta g_i_qxi} = T_{cd_xi}\frac{L_{i_qxi}}{L_{YD_xi}}.$$

For another example, in the case that the guide speed presented when the Nxi horizontal ground traffic light sets are driven to emit the allow-to-travel light signal sequentially from the horizontal ground traffic light set qxi is a uniform acceleration guide speed, an interval length $T_{\Delta g_i_qxi}$ of a starting time of an allow-to-travel light signal emitted by the horizontal ground traffic light set i, among the Nxi horizontal ground traffic light sets, relative to the starting time of the allow-to-travel light signal emitted by the horizontal ground traffic light set qxi is expressed as $$T_{\Delta g_i_qxi} = T_{cd_xi}\sqrt{\frac{L_{i_qxi}}{L_{YD_xi}}}.$$

When the initial speed $v_0$ of the uniform acceleration guide speed is greater than 0, the general expression formula of the interval length $T_{\Delta g_i_qxi}$ is expressed as $$T_{\Delta g_i_qxi} = \frac{T_{cd_xi}\sqrt{(v_0T_{cd_xi})^2 + 4L_{i_qxi}(L_{YD_xi} - v_0T_{cd_xi})} - v_0T_{cd_xi}^2}{2(L_{YD_xi} - v_0T_{cd_xi})},$$

where $T_{cd_xi}$ represents an overlap time length corresponding to the entrance lane xi, and $T_{cd_xi}$ also represents an interval length of a starting time of the allow-to-travel light signal emitted by the horizontal ground traffic light set pxi and a starting time of the allow-to-travel light signal emitted by the horizontal ground traffic light set qxi. $L_{YD_xi}$ represents a distance (that is the length of an entrance guide area of the entrance line xi) between a stop line and an intersection safety line of the entrance line xi, and $L_{YD_xi}$ also represents a distance between the horizontal ground traffic light set pxi and the horizontal ground traffic light set qxi.

$L_{i_qxi}$ represents a distance between the horizontal ground traffic light set i and the horizontal ground traffic light set qxi, and $L_{i_qxi}$ represents a distance between the horizontal ground traffic light set i and a stop line of the entrance line xi. The horizontal ground traffic light set i is any one of the Nxi horizontal ground traffic light sets.

In one implementation, the values of $L_{YD_xi}$ and/or $T_{cd_xi}$ can be fixed or changed with the environment. In general, for safety reasons, the speed of the first vehicle entering the intersection behind the stop line in the entrance lane xi is preferably in a safe range, for example, a speed of 15 km per hour or 20 km per hour is a relatively safe range. If the speed of the first vehicle is within a safe range, the first vehicle can brake in time when there is an unexpected situation at the intersection, which helps to reduce the probability of accidents at the intersection. For these safety considerations, the driving speed of the first vehicle entering the intersection is guided to the safe range using the guide speed presented by the allow-to-travel light signal emitted by the Nxi horizontal ground traffic light sets, and therefore the security at the intersection can be further ensured.

For example, the time length required for an ordinary vehicle from starting acceleration to safe speed is a reference for $\overline{T_{cd_xi}}$. The distance required for an ordinary vehicle from starting acceleration to safe speed is a reference for $\overline{L_{YD_xi}}$. $\overline{T_{cd_xi}}$ represents a proposed initial value of the overlap time corresponding to the entrance lane xi, and $\overline{L_{YD_xi}}$ represents a proposed initial value of the length of the entrance guide area of the entrance lane xi.

For example, the value of $L_{YD_xi}$ can be equal to $\overline{L_{YD_xi}}$, and the value of $T_{cd_xi}$ can be equal to $\overline{T_{cd_xi}}$. In the case that The value of $L_{YD_xi}$ and/or $T_{cd_xi}$ may vary with the environment $T_{cd_xi}=\overline{T_{cd_xi}}*\mu1$, and $L_{YD_xi}=\overline{L_{YD_xi}}*\mu2$.

In one implementation, μ1 is a first safety factor, and μ2 is a second safety factor. In other words, the corresponding safety factor can be selected according to the change of the current environmental factor, and then the value of currently used $T_{cd_xi}$ (or $L_{YD_xi}$) can be obtained based on $\overline{T_{cd_xi}}$(or $\overline{L_{YD_xi}}$) and the currently selected safety factor.

The value of μ1 (or μ2) can be equal to 1. The value of μ1 (or μ2) may be greater than or less than 1. The value of μ1 (or μ2) can be determined, for example, with reference to environmental factors such as weather, light intensity, slope, and/or intersection complexity. For example, the value of μ1 (or μ2) may be equal to or close to 1 (such as, 1.1, 1.05, or other values) when the weather is sunny, and the value of μ1 (or μ2) (such as, 1.2, 1.3, 1.5, 2, or other values) when the weather is rainy is greater than the value of μ1 (or μ2) when it is sunny. For another example, when the light intensity is good, the value of μ1 (or μ2) may be equal to or close to 1 (such as, 1.1, 1.05, or other values), and when the light intensity is poor, the value of μ1 (or μ2) (such as, 1.2, 1.3, 1.5, 2, or other values) is greater than the value of μ1 when the light intensity is good. For another example, when the slope is steeper, the value of μ1 (or μ2) may be equal to or close to 1 (for example, 1.1, 1.06, or other values), and the value of μ1 (or μ2) (such as, 1.2, 1.3, 1.5, 1.8, 2, or other values) when the slope is small is greater than the value of μ1 when the slope is steeper. For example, when the intersection complexity is small, the value of μ1 (or μ2) is equal to or close to 1 (such as 1.1, 1.04, 1.08, or other values), and when the intersection complexity is larger, the value of μ1 (or μ2) (such as, 1.2, 1.3, 1.5, 1.7, 1.9, 1.8, 2, or other values) is greater than the value of μ1 (or μ2) when the intersection complexity is small.

It will be understood that the setting of μ1 (or μ2) aims to improve security, so the value of μ1 (or μ2) may also be determined by referring to one or more other factors that affect security. Specifically, how to determine factors that affect safety, and how to determine the value of μ1 (or μ2) by referring to factors that affect safety, which can be selected according to the needs of specific scenarios, which is not specifically limited thereto.

For another example, there may be a corresponding relationship between different time periods and stop line positions, that is, there may be a corresponding relationship between different time periods and the length $L_{YD_xi}$ of the entrance guide area. For example, the stop line position corresponding to the busy hour (such as, the $L_{YD_xi}$ is 10 meters or other values during this period), the stop line position corresponding to the semi-busy hour (such as, $L_{YD_xi}$ is 8 meters during this period), and the stop line position corresponding to the idle period (such as, $L_{YD_xi}$ is 6 meters during this period) may be set in advance. For example, the time period of 7:30 to 9:30 and 17:30 to 20:00 may be designated as busy periods, the time period of 0:00 to 6:00 may be defined as idle periods, and other periods may be defined as semi-busy periods; further there may be other time division methods corresponding to different application scenarios, which will not be illustrated here.

For another example, there may be a corresponding relationship between the traffic volume and the stop line position. That is, there may be a corresponding relationship between the different time periods and the length $L_{YD_xi}$ of the entrance guide area. For example, when the traffic volume of the intersection is greater than 100 vehicles per minute, $L_{YD_xi}$ is 10 meters or other values. When the traffic volume of the intersection is about 60 to 100 vehicles per minute, the length $L_{YD_xi}$ of the entrance guide area is 8 meters or other values. When the traffic volume of the intersection is less than 30 vehicles per minute, the length $L_{YD_xi}$ of the entrance guide area is 6 meters or other values, and so on.

In addition, there may also be a corresponding relationship between the area of the intersection and the corresponding overlap time length and the length of the entrance guide area. For example, a relatively large plane intersection, the overlap time and the length of the entrance guide area may be relatively large, and a relatively small plane intersection, the overlap time and the length of the entrance guide area can be relatively small.

In the case that control phase includes the clear phase, some current traffic regulations stipulate that the clear phase (intersection full red period) is fixed at 2 seconds, taking into account that different lanes of different plane intersections may have different clear lengths, and the different lanes of the same plane intersection may also have different clear lengths. The clear phase time length is a specific value that is not necessarily science. Therefore, it can be considered that the clear phase time length $T_{qk}$ corresponding to the clear length of the lane is obtained. For example, $$T_{qk_xi} = \frac{L_{qk_xi}}{V'_{lk_xi}}$$

or when $$\frac{L_{qk_xi}}{V'_{lk_xi}}$$

is greater than or equal to 2 seconds, $$T_{qk_xi} = \frac{L_{qk_xi}}{V'_{lk_xi}} . T_{qk_xi}$$

takes 2 seconds when $$\frac{L_{qk_xi}}{V'_{lk_xi}}$$

is less than 2 seconds. $T_{qk_xi}$ indicates the clear phase time length of the entrance lane xi. $L_{qk_xi}$ indicates the clear length corresponding to the entrance lane xi ($L_{qk_xi}$ is equal to the length of the entrance guide area of the entrance lane xi plus (+) the length of the intersection corresponding to the entrance lane xi). $V'_{lk_xi}$, for example, is equal to the minimum speed limit $V_{lk_min}$ or the desired speed $V_{lk_q}$ at the plane intersection to which the entrance lane xi belongs. Alternatively, $V'_{lk_xi}$ may be equal to $V_{lk_min}$*μ3 or $V_{lk_q}$*μ3. The value of the third safety factor μ3 may be equal to, greater than, or less than 1. Specifically, the value of μ3 may be determined based on environmental factors such as weather, light intensity, slope, and/or intersection complexity, and the specific value of μ3 may refer to the specific value of μ1.

The $T_{qk_xi}$ obtained based on the above example may not be a fixed time length of 2 seconds, and $T_{qk_xi}$ may be adaptively changed according to the specific intersection conditions, to better ensure that vehicles do not have conflicts at intersections, which in turn helps to further improve the safety of road crossings.

In some possible implementations, the method further includes: driving the Nxi horizontal ground traffic light sets to synchronously emit a prohibit-to-travel light signal when the control phase of the entrance lane xi ends; or driving the Nxi horizontal ground traffic light sets to synchronously emit the prohibit-to-travel light signal when there is the clear phase time length left before the control phase of the entrance lane xi ends; or driving the Nxi horizontal ground traffic light sets to sequentially emit the prohibit-to-travel light signal from the horizontal ground traffic light set qxi when there is the clear phase time length left to the end of the control phase of the entrance lane xi, where the closer a distance between a horizontal ground traffic light set among the Nxi horizontal ground traffic light sets and the horizontal ground traffic light set qxi is, the earlier a starting time when the horizontal ground traffic light set emits the prohibit-to-travel light signal is; where a starting time of a prohibit-to-travel light signal emitted by the horizontal ground traffic light set pxi is later than that emitted by any horizontal ground traffic light set among the Nxi horizontal ground traffic light sets.

For example, an interval of the starting time of the prohibit-to-travel light signal emitted by the horizontal ground traffic light set pxi and the starting time of the prohibit-to-travel light signal emitted by the horizontal ground traffic light set qxi is equal to a clear time length of an entrance guide area of the entrance lane xi, where the clear time length of the entrance guide area of the entrance lane xi is represented as $T_{YD_qk_xi}$, and $$T_{YD_qk_xi} = \frac{L_{YD_xi}}{V'_{YD_qk_xi}},$$

where $V'_{YD_qk_xi}$ may be equal to $V_{lk_max}$, $V_{lk_min}$, or $V_{lk_q}$, where $V_{lk_max}$ represents the maximum speed limit at the plane intersection, $V_{lk_min}$ in represents a minimum speed limit at the plane intersection, and $V_{lk_q}$ represents a desired speed at the plane intersection. Here, the clear time length $T_{YD_qk_xi}$ of the entrance guide area is less than the overlap time length $T_{cd_xi}$ for example. $V_{lk_min}$ is less than $V_{lk_max}$. The value domain space of $V_{lk_q}$ is any real number greater than or equal to $V_{lk_min}$ and less than or equal to $V_{lk_max}$; that is $V_{lk_q}$ is greater than or equal to the $V_{lk_min}$ and less than or equal to $V_{lk_max}$.

As an example, in the case that guide speed presented when the Nxi horizontal ground traffic light sets are driven to emit the prohibit-to-travel light signal sequentially from the horizontal ground traffic light set qxi is constant guide speed, an interval length $T_{\Delta r_i_qxi}$ of the starting time of a prohibit-to-travel light signal emitted by the horizontal ground traffic light set qxi and the starting time of a prohibit-to-travel light signal emitted by the horizontal ground traffic light set i among the Nxi horizontal ground traffic light sets is expressed as $$T_{\Delta r_i_qxi} = T_{YD_qk_xi} \frac{L_{i_qxi}}{L_{YD_xi}},$$

where $L_{i_qxi}$ represents a distance between the horizontal ground traffic light set i and the horizontal ground traffic light set qxi, and the horizontal ground traffic light set i is any one of the Nxi horizontal ground traffic light sets.

Optionally, in some possible implementations, the method further includes: driving the Nxi horizontal ground traffic light sets to synchronously emit the warn-to-travel light signal when there is a clear phase time length plus the transition phase time length left to the end of the control phase of the entrance lane xi; driving the Nxi horizontal ground traffic light sets from the horizontal ground traffic light set qxi to sequentially emit the warn-to-travel light signal when there is the clear phase time length plus the transition phase time length left to the end of the control phase of the entrance lane xi, where the closer a distance between a horizontal ground traffic light set among the Nxi horizontal ground traffic light sets and the horizontal ground traffic light set qxi is, the earlier a starting time when the horizontal ground traffic light set emits the warn-to-travel light signal is; where a starting time of a warn-to-travel light signal emitted by the horizontal ground traffic light set pxi is later than that emitted by any horizontal ground traffic light set among the Nxi horizontal ground traffic light sets. For example, an interval of the starting time of the warn-to-travel light signal emitted by the horizontal ground traffic light set pxi and the starting time of the warn-to-travel light signal emitted by the horizontal ground traffic light set qxi is equal to the clear time length of the entrance guide area of the entrance lane xi.

Figure 6:
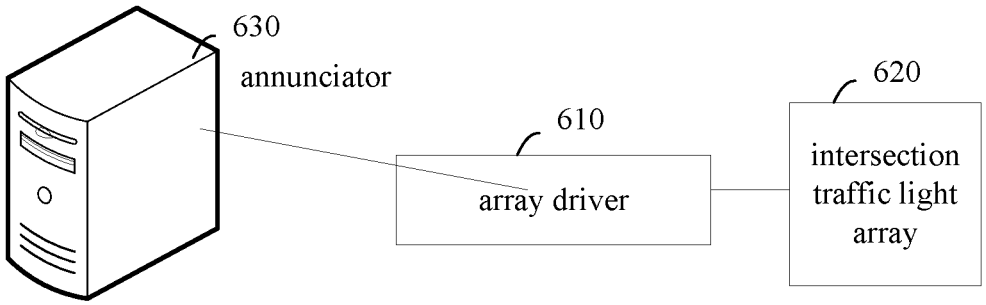
FIG. 6 is a schematic diagram illustrating a system for an intersection traffic light according to an implementation of the present disclosure.
Figure 7:
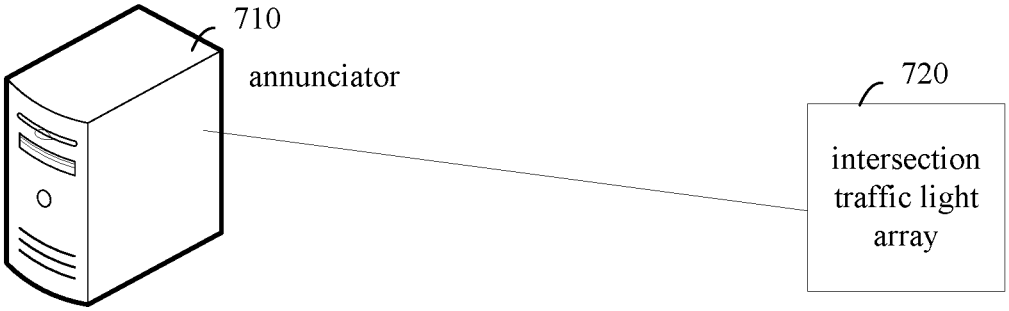
FIG. 7 is a schematic diagram illustrating another driving control system for an intersection traffic light according to an implementation of the present disclosure.

In practical applications, the main body of execution of the above method may be a signal lamp driving control apparatus such as an annunciator or an array driver. The annunciator mentioned in the implementation of the present application may also be called a program-controlled switchboard, a traffic control annunciator, a traffic annunciator, an intersection annunciator, an intersection traffic annunciator, or an intersection traffic control annunciator. FIG. 6 and FIG. 7 illustrate some possible connection relationships of an annunciator, an array driver, and an intersection traffic light arrays. Specifically, the annunciator or the array driver may output a control signal to the intersection traffic light array to drive the intersection traffic light array to operate. In practical applications, each horizontal ground traffic light set can operate under the control of an annunciator. Or each horizontal ground traffic light set can operate under the control of an array driver connected to the annunciator.

For example, since the starting and ending time (such as, a starting and ending time of a go phase, a starting and ending time of a transition phase, a starting and ending time of a stop phase, etc.) of the control phase of the entrance lane are determined by the annunciator, the starting and ending time of these phases may be recorded in a phase-time table maintained by the annunciator. Therefore, the starting and ending time of the control phase of each entrance lane can be learned by the annunciator; that is, the annunciator can learn when the time there is an overlap time length $T_{cd_xi}$ left to the end of a last intersection conflict control phase of a control phase of the entrance lane xi. The array driver can learn directly or indirectly from the annunciator (or other apparatuses connected with or controlled by the annunciator) when the time there is an overlap time length $T_{cd_xi}$ left to the end of a last intersection conflict control phase of a control phase of the entrance lane xi. For example, the array driver may learn when the time there is an overlap time length $T_{cd_xi}$ left to the end of a last intersection conflict control phase of a control phase of the entrance lane xi based on the countdown signal for the go phase or stop phase from the annunciator (or other apparatuses connected with or controlled by the annunciator).

In some technical solutions of the implementations of the present application, by introducing the entrance guide area and the overlap mechanism of the intersection conflict control phase, the next intersection conflict control phase of a current control phase can be controlled to pass when there is an overlap time length left before the end of the current control phase. In this way, when the current control phase has not been completed, the next intersection control phase has already started, and the overlap of the intersection control phase can be realized, so that the vehicle of the entrance lane corresponding to the next intersection conflict control phase can be guided to accelerate in advance at the entrance guide area. The speed at which the vehicle reaches the intersection may be relatively higher, so that the time required to pass through this plane intersection can be shortened. This method can greatly improve the efficiency of vehicle traffic at the plane intersection, and thus can lay a foundation for alleviating traffic congestion.

In addition, since the interval length of the starting time of light signals of allowing the vehicle to pass through emitted by the horizontal ground traffic light set pxi and the horizontal ground traffic light set qxi is equal to the overlap time length, when the vehicle on the entrance lane xi are driven to the intersection under the guidance of the Nxi horizontal ground traffic light sets, the last intersection conflict control phase of the control phase of the entrance lane xi has already ended, which is beneficial to make the vehicle on the entrance lane xi at the intersection be prevented from conflicting with conflict passing vehicles at other intersections, thereby facilitating the security of the vehicles on the entrance lane xi crossing the intersections.

Figure 5B:
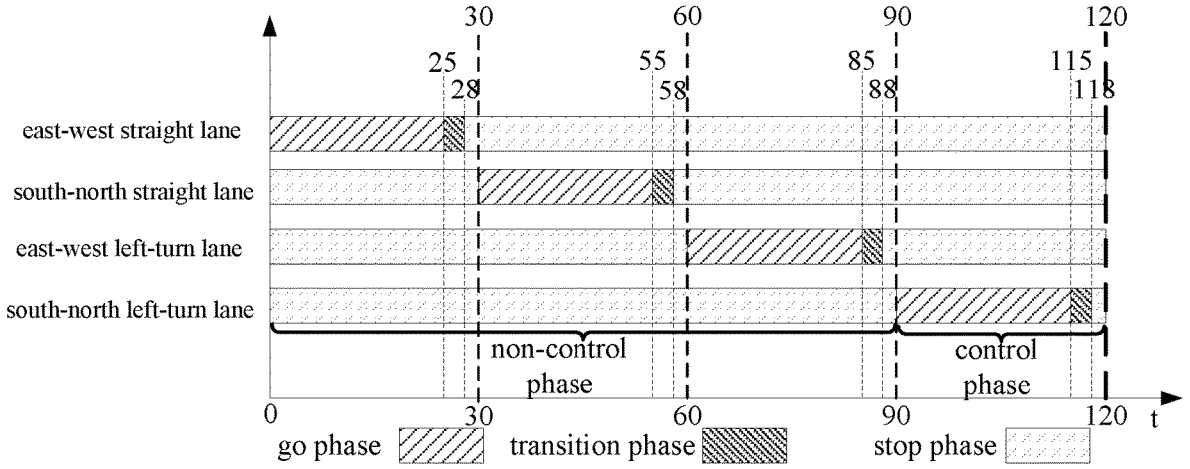

The following is described with a specific example. Assuming that there is a plane intersection that the north-south and west-east directions intersect, and that the total time length of the phase period of the entire plane intersection is fixed at 120 seconds. One phase cycle of the entire plane intersection is a cycle of control phase (such as, control phase of north-south straight lanes, north-south left-turn lanes, west-east straight lanes, and west-east left-turn lanes) of the conflict lanes of all intersections of the plane intersection. In a conventional scheme, the setting of the control phases of conflict lanes in each set of the intersections can be illustrated in FIG. 5B. There is no time overlap between the control phases of the conflict lanes in each set of intersections. When the total time length of the phase period of the entire plane intersection is assumed to be fixed at 120 seconds, the control phases of the conflict lanes of the four intersections of the north-south straight lane, the north-south left-turn lane, the west-east straight lane, or the west-east left-turn lane is generally 30 seconds respectively. Assuming that the time length of the control phase of the north-south left-turn lane is 30 seconds, the time length of the non-control phase of the north-south left-turn lane illustrated in FIG. 5B is 0 to 90 seconds, and the time length of the control phase of the north-south left-turn lane illustrated in FIG. 5B is 90 to 120 seconds. The control phase of the north-south left-turn lane includes 25 seconds of a go phase (such as, green light phase), 3 seconds of a transition phase (such as, yellow light phase), and 2 seconds of the clear phase (intersection full red period). In this case, The corresponding effective traffic time length of about 24 seconds may be equal to the traffic phase of 25 seconds to 2 seconds (where the subtracted 2 seconds can be considered as the driver response time+vehicle start-up time, etc., may be referred to as the traffic phase loss time length)+the available transition phase time length of 1 second (assuming that the transition phase time length of 3 seconds includes: the available transition phase time length of 1 second+the unavailable transition phase time length of 2 seconds). The total loss time of a single control phase (which can be called the conversion loss time length of the control phase) is equal to the unavailable transition phase time length of about 2 seconds+clear phase of 2 seconds+traffic phase loss time length of 2 seconds; that is, the total loss time is about 6 seconds.

After implementing the scheme of the present application, it is assumed that the overlap time length (i.e., the pre-acceleration time period) of the intersection conflict control phase is 8 seconds. The distance between the stop line and the intersection safety line is adapted to the overlap time length, and thus an overlap time of 8 seconds between control phases of intersection conflict lanes (such as, the north-south straight lane and the west-east straight lane). The various phases of the each set of the intersection conflict lanes that are set in an overlap manner can be illustrated in FIGS. 5C and 5D.

Figure 5C:
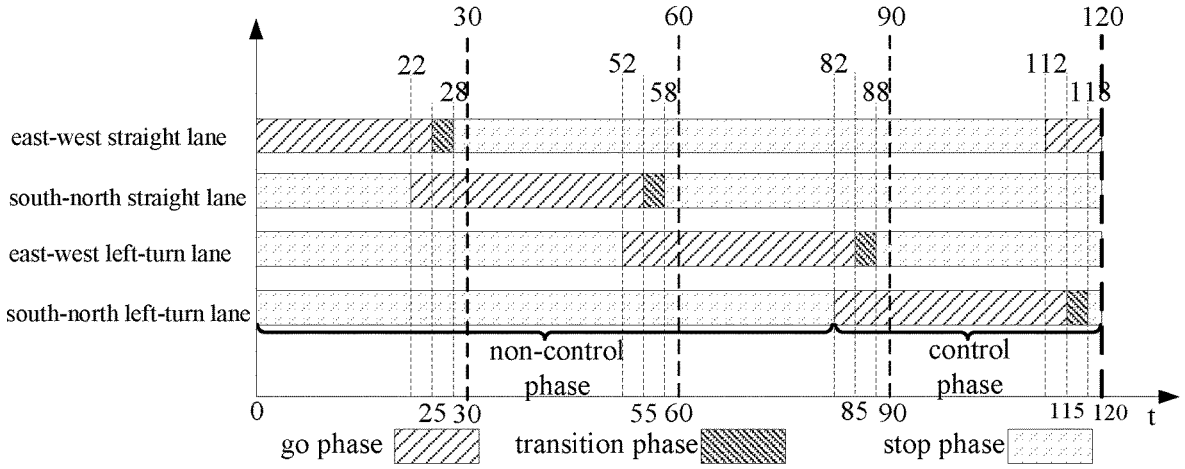

As illustrated in FIG. 5C, the following describes that the total time length of the phase cycle of the entire plane intersection is still fixed at 120 seconds as an example.

In the scenario illustrated in FIG. 5C, since the control phase of the north-south left-turn lane begins 8 seconds ahead of schedule, if an ending time of the control phase of the north-south left-turn lane is not changed, the time length of the control phase can be extended from 30 seconds to 38 seconds (the non-control phase of the north-south left-turn lane illustrated in FIG. 5C is 0-82 seconds, and the control phase of the north-south left-turn lane illustrated in FIG. 5C is 82-120 seconds). The effective traffic time length is a total of about 31 seconds that is equal to 38 seconds—the transition loss time length of the control phase (unusable transition phase time length of approximately 2 seconds+clear phase of approximately 3 seconds (clear time length of the intersection of approximately 2 seconds+clear time length of the entrance guide area of approximately 1 second)+traffic phase loss time length of about 2 seconds, a total of about 7 seconds). The north-south straight lane, the west-east straight lane, and the west-east left-turn lane is similar to the above situation.

In the scenario illustrated in FIG. 5C, the effective traffic time length of the single control phase of the north-south left-turn lane relatively improved ((31−24)/24) is 29% under the condition that the total time length (120 seconds) of the phase period of the entire plane intersection is constant, which is beneficial to increase the efficiency of vehicle traffic.

Figure 5D:
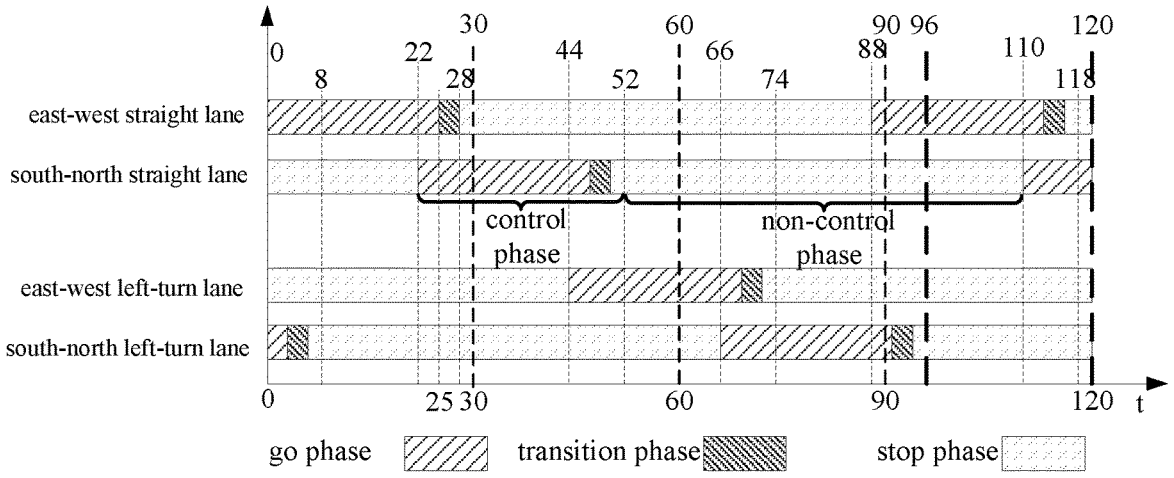

In the scenario illustrated in FIG. 5D, the following describes that the time lengths of the control phases of the four sets of the intersections conflict lanes that are the north-south straight lane, the north-south left-turn lane, the west-east straight lane, and the west-east left-turn lane are respectively fixed at 30 seconds as an example. In this case, as illustrated in FIG. 5D, the total phase period time length of the entire plane intersection is reduced from 120 seconds to 96 seconds through the overlap of the intersection conflict control phase.

In the scenario illustrated in FIG. 5D, under the condition that the total time length of the phase period of the entire plane intersection is greatly reduced (reduced from the 120 seconds to 96 seconds), the time lengths of the control phases of the four intersection conflict lanes of the north-south straight lane, the north-south left-turn lane, the west-east straight lane, and the west-east left-turn lane have not been shortened, and thus effective traffic time length of the corresponding control phase has not been shortened. Since the total time length of the phase period of the entire plane intersection is shortened, the number of phase periods of the entire plane intersection that can be arranged within the same time length (such as within one hour) can be greatly increased. Therefore, the corresponding effective traffic time length will inevitably increase with the same time length range, which can be beneficial to improving the efficiency of the vehicle traffic. In the technical solutions of the implementations of the present application, without reducing the effective traffic time length of a single control phase, the phase period of the plane intersection can use a relatively shorter period compared to a total time length, which is beneficial to solving the problem of waiting for the longer period for the people at the plane intersection. In the traditional solutions, to reduce the proportion of the conversion loss time length of the control phase in the time length of the control phase, the usual method is to set the total time length of the phase period of the plane intersection very long. For example, the total time length of a single-phase period at some plane intersections is as long as 240 seconds, which makes pedestrians and vehicles wait a very long time for red lights, such that the long time required for waiting for red lights sometimes will challenge people's tolerance limits and cause widespread criticism.

In the examples shown in FIG. 5C and FIG. 5D, an overlap time length (i.e., pre-acceleration time length) of the intersection conflict control phase adjacent in time is 8 seconds, and the overlap time length may be other values. For example, it may be 1 second, 2 seconds, 3.5 seconds, 5 seconds, 6 seconds, 8 seconds, 9 seconds, 10 seconds, or other value less than a corresponding time length of control phase, and corresponding implementations can be implemented in a similar way. In the examples shown in FIG. 5C and FIG. 5D, the control phrase includes go phase, transition phase, and clear phase. The control phase may also be other combinations shown in FIG. 2C. For example, the control phase may include go phase and clear phase, but does not include transition phase. In addition, corresponding implementations where the control phase is other combinations can also be implemented in a similar way.

In general, implementing the solution of the implementation of the present application can relatively increase the effective traffic time length on the premise that the total time length of the phase period of the plane intersection is unchanged, or can also shorten the total time length of the phase period of the entire plane intersection, on the premise that the time length of the single control phase. By introducing the overlap mechanism and the entrance guide area of the intersection conflict control phase, which can offset the conversion loss time length of the control phase, and can further improve the speed of vehicles passing through the intersection. According to the time=distance/speed, with the same time, the faster the speed is, the more vehicles that pass is and the higher the traffic efficiency is. Compared with the conventional scheme that the conversion loss time length of the control phase can be reduced by extending the total time length of the phase period, the technical solution of the implementation of the present application can greatly reduce the total time length of the phase period of the entire plane intersection, and can further shorten the time of waiting for red lights, which will help reduce fuel consumption and emission of waste gas.

For example, assume that each car goes through 5 plane intersections every day, 30 seconds waiting for a red light at each plane intersection can be saved, each car in an idle speed consumes 1 liter gasoline in average per hour, and there are one million vehicles in a city, hundreds of millions fuel can be saved per year. For example, (5*0.5 minutes*1 liter/60 minutes)*360 days*1 million vehicles=1,500 million liters. Assume that every liter of gasoline costs 7 rmb, 15 million liters of gasoline*7rmb=105 million rmb can be saved each year. This saves social resources while improving traffic efficiency.

Further, it is relatively easy to carry out the engineering reforming of the scheme of the implementations of the present disclosure, and the original transportation facilities can also be basically retained. For example, the original photo sensing and other facilities can basically continue to be used. Starting time of each intersection conflict control phase is mainly adjusted. The stop line disposed at the intersection safety line location (e.g., a location where the horizontal ground traffic light set pxi is disposed) in related art is moved backwards from the intersection safety line, so as to separate the intersection safety line and the stop line (e.g., a location where the horizontal ground traffic light set qxi is disposed) in space. A section defined between the stop line and the intersection safety line forms an entrance guide area. Further, because the stop line is relatively far from the crosswalk, when the car starts, basically there is no need to worry about pedestrians suddenly rushing out of the crosswalk. Moreover, when the pedestrians cross the road, they basically do not have to worry about vehicles running a red light. This, to some extent, achieves separation of pedestrians and vehicles without disturbing each other.

Further, as in the related technology, the total duration of the phase cycle of the plane intersection is usually very long, resulting in a very long waiting time, and the duration of a single control phase is also long. When the distance between two plane intersections is relatively close, it is very easy to cause the vehicles to stay in the intersections. This will affect corresponding vehicles to be released in the next control phase to pass through the intersection, resulting in jam, and commonly known running a green light. Most traffic jams in the rain and fog are also due to this reason. After implementing some of the technical solutions of the present disclosure, it is beneficial to shortening the total duration of the phase cycle of the plane intersection, which helps alleviate the phenomenon of running the green light. At the same time, the total duration of the phase cycle of the plane intersection is greatly shortened, which can reduce the number of public transport vehicles that are released during a single-phase cycle, reducing the number of public transport vehicles staying at the bus station.

Referring to FIG. 6, an implementation of the disclosure also provides a system for an intersection traffic light. The system includes an annunciator 630, an intersection traffic light array 620, and an array driver 610 configured to drive the intersection traffic light array 620. The intersection traffic light array 620 is connected with the array driver 610 (e.g., a wired connection or a wireless connection). For example, the intersection traffic light array 620 may be any intersection traffic light array in the above implementations.

In practical applications, each horizontal ground traffic light set can operate under driving control of the array driver 610. For example, the array driver may drive the intersection traffic light array to work by directly or indirectly outputting a control signal or a power supply signal to the intersection traffic light array, where the control signal or the power supply signal may also be regarded as some expressions of a driving signal. As one implementation, the array driver may output the driving signal (for example, a first driving signal, a second driving signal, or a third driving signal) to the horizontal ground traffic light set of the intersection traffic light array to drive a corresponding horizontal ground traffic light set to issue A1 light signal, A2 light signal, or A3 light signal.

In practical applications, the annunciator 630 may provide some relevant signals to the array driver 610. For example, the annunciator may provide the array driver 610 with a go phase or a stop phase countdown signal of the lane, and the like. Alternatively, the annunciator may send a trigger signal to the array driver 610. The trigger signal may, for example, indicate a current time is a time when there is an overlap time length Tcd_xi left to the end of a last intersection conflict control phase of a control phase of the entrance lane xi. The annunciator may also transmit the array driver 610 a configuration file or the like that records the overlap time length Tcd_xi.

Referring to FIG. 7, an implementation of the disclosure also provides another driving control system for an intersection traffic light. The system includes an intersection traffic light array 720 and an annunciator 710 configured to drive the intersection traffic light array 720. The intersection traffic light array 720 is connected with the annunciator 710 (e.g., a wired connection or a wireless connection). For example, the intersection traffic light array 720 may be any intersection traffic light array in the above implementations.

In practical applications, each horizontal ground traffic light set can operate under driving control of the annunciator 710. For example, the annunciator 710 may drive the intersection traffic light array to work by directly or indirectly outputting a control signal or a power supply signal to the intersection traffic light array, where the control signal or the power supply signal may also be regarded as some expressions of a driving signal. As one implementation, the annunciator 710 may output the driving signal (for example, a first driving signal, a second driving signal, or a third driving signal) to the horizontal ground traffic light set of the intersection traffic light array to drive a corresponding horizontal ground traffic light set to issue A1 light signal, A2 light signal, or A3 light signal.

Figure 8:
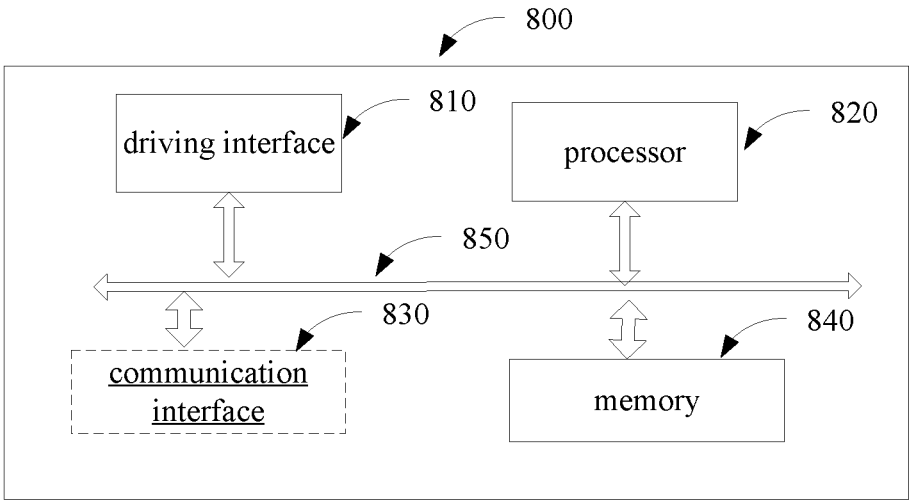
FIG. 8 is schematic diagram illustrating a driving control apparatus for an intersection traffic light array according to an implementation of the present disclosure.

Referring to FIG. 8, an implementation of the present disclosure provides a driving control apparatus for an intersection traffic light array, where the intersection traffic light array may be any intersection traffic light array in the above implementations. The driving control apparatus 800 for the traffic light array may include a driving interface 810, a processor 820, a memory 840, and the like. A communication interface 830 may also be included. The communication interface 830 can communicate with apparatuses such as hosts or slaves.

The memory 840 may include a read-only memory and a random access memory, and provide the processor 820 with instructions and data. In addition, a portion of the memory 840 may also include a non-transitory random access memory. The processor 820 is mainly configured to control operations of the driving control apparatus 800, and the processor 820 may also be referred to as a central processing unit (CPU). In applications, various components of the driving control apparatus 800 are coupled together via a bus system 850. The bus system 850 may include a power bus, a control bus, a status signal bus, and the like besides a data bus. However, for clarity of description, various buses are marked as the bus system 850 in FIG. 8.

The method disclosed in the foregoing implementations of the present disclosure may be applied to the processor 820 or implemented by the processor 820. The processor 820 may be an integrated circuit chip with signal processing capabilities. In the implementation process, each operation of the above method may be achieved by an integrated logic circuit of hardware in the processor 820 or instructions in the form of software. The above-mentioned processor 820 may be a general-purpose processor, a digital signal processor (DSP), an application-specific integrated circuit (ASIC), an off-the-shelf programmable gate array (FPGA), or other programmable logic device, a discrete gate or a transistor logic device, discrete hardware components. The method, operations, and logic blocks disclosed in the implementations of the present disclosure may be implemented or executed. A general purpose processor may be a microprocessor or the processor may be any common processor or the like. The operations of the method disclosed in conjunction with the implementations of the present disclosure may be directly implemented by a hardware decoding processor, or may be performed by a combination of hardware and software modules in the decoding processor. The software modules may be located in mature storage medium in the field, such as random access memory, flash memory, read-only memory, programmable read-only memory or electrically erasable programmable memory, registers, and the like. The storage medium is located in the memory 840. For example, the processor 820 can read the information in the memory 840 and perform the operations of the above method in combination with hardware thereof.

For example, the processor 820 is configured to drive the Nxi horizontal ground traffic light sets to emit an allow-to-travel light signal sequentially from the horizontal ground traffic light set qxi when there is an overlap time length Tcd_xi left to the end of a last intersection conflict control phase of a control phase of the entrance lane xi. The closer a distance between a horizontal ground traffic light set among the Nxi horizontal ground traffic light sets and the horizontal ground traffic light set qxi is, the earlier a starting time when the horizontal ground traffic light set is driven to emit the allow-to-travel light signal is. A starting time of a A2 light signal emitted by driving the horizontal ground traffic light set pxi is later than that emitted by driving any horizontal ground traffic light set among the Nxi horizontal ground traffic light sets, and an interval TΔ_pxi_qxi of the starting time of the allow-to-travel light signal emitted by the horizontal ground traffic light set pxi and a starting time of an allow-to-travel light signal emitted by the horizontal ground traffic light set qxi is equal to the overlap time length Tcd_xi.

For example, the driving control apparatus 800 may be an annunciator or an array driver, or the driving control apparatus 800 may be built in the annunciator or the array driver. It can be understood that, functions of the functional modules of the driving control apparatus 800 in the implementation may be implemented according to the method in the foregoing method-implementation. For an implementation process, reference may be made to the related description of the foregoing method-implementation, and details are not repeated herein again.

In the foregoing implementations, the description of each implementation has its own emphasis. For the parts not described in detail in one implementation, reference may be made to related descriptions in other implementations. In the implementations of the disclosure, it should be understood that, the apparatus disclosed in implementations provided herein may be implemented in other manners. For example, the device/apparatus implementations described above are merely illustrative; for instance, the division of the unit is only a logical function division and there can be other manners of division during actual implementations, for example, multiple units or components may be combined or may be integrated into another system, or some features may be ignored, omitted, or not performed. In addition, coupling or communication connection between each illustrated or discussed component may be direct coupling or communication connection, or may be indirect coupling or communication among devices or units via some interfaces, and may be electrical connection, mechanical connection, or other forms of connection.

The units described as separate components may or may not be physically separated, the components illustrated as units may or may not be physical units, that is, they may be in the same place or may be distributed to multiple network elements. All or part of the units may be selected according to actual needs to achieve the purpose of the technical solutions of the implementations.

The integrated unit may be stored in a computer-readable memory when it is implemented in the form of a software functional unit and is sold or used as a separate product. Based on such understanding, the technical solutions of the present disclosure essentially, or the part of the technical solutions that contributes to the related art, or all or part of the technical solutions, may be embodied in the form of a software product which is stored in a memory and includes instructions for causing a computer device (which may be a personal computer, a server, or a network device and so on) to perform all or part of the steps described in the various implementations of the present disclosure. The memory includes various medium capable of storing program codes, such as a USB (universal serial bus) flash disk, a read-only memory (ROM), a random access memory (RAM), a removable hard disk, Disk, compact disc (CD), or the like.

What is claimed is:

1. A driving control method for an intersection traffic light array, wherein the intersection traffic light array comprises Nxi horizontal ground traffic light sets; wherein the Nxi horizontal ground traffic light sets comprise a horizontal ground traffic light set pxi which is disposed at an intersection safety line position of an entrance lane xi of a plane intersection; wherein the Nxi horizontal ground traffic light sets further comprise a horizontal ground traffic light set qxi which is disposed at a stop line position of the entrance lane xi, and Nxi is an integer greater than 1; wherein each horizontal ground traffic light set of the Nxi horizontal ground traffic light sets comprises at least one traffic light, and part or all of traffic lights of a horizontal ground traffic light set i have at least one of a wireless driving signal input port and a wired driving signal input port; wherein the horizontal ground traffic light set i is one or any one of the Nxi horizontal ground traffic light sets; and wherein the driving control method comprises:

driving the Nxi horizontal ground traffic light sets to emit an allow-to-travel light signal sequentially from the horizontal ground traffic light set qxi when a time length from the beginning of a control phase of the entrance lane xi to the end of a last intersection conflict control phase is equal to an overlap time length $T_{cd_xi}$; wherein the closer a distance between a horizontal ground traffic light set among the Nxi horizontal ground traffic light sets and the horizontal ground traffic light set qxi is, the earlier a starting time when the horizontal ground traffic light set is driven to emit an allow-to-travel light signal is; wherein a starting time of an allow-to-travel light signal emitted by driving the horizontal ground traffic light set pxi is later than that emitted by driving any horizontal ground traffic light set among the Nxi horizontal ground traffic light sets, and an interval $T_{\Delta_pxi_qxi}$ of the starting time of the allow-to-travel light signal emitted by the horizontal ground traffic light set pxi and a starting time of an allow-to-travel light signal emitted by the horizontal ground traffic light set qxi is equal to the overlap time length $T_{cd_xi}$.

2. The driving control method of claim 1, wherein a distance between any two adjacent horizontal ground traffic light sets among the Nxi horizontal ground traffic light sets is equal, or, among the Nxi horizontal ground traffic light sets, the farther two adjacent horizontal ground traffic light sets from the horizontal ground traffic light set pxi is, the smaller a distance between the two adjacent horizontal ground traffic light sets is; or among the Nxi horizontal ground traffic light sets, the closer a distance among two adjacent horizontal ground traffic light sets and the horizontal ground traffic light set pxi is, the larger a distance between the two adjacent horizontal ground traffic light sets is.

3. A non-transitory computer storage medium, wherein the non-transitory computer storage medium is configured to store programs that, when executed, are operable to execute the method of claim 1.

4. The driving control method of claim 1, wherein guide speed presented when the Nxi horizontal ground traffic light sets are driven to emit the allow-to-travel light signal sequentially from the horizontal ground traffic light set qxi is constant guide speed or variable guide speed.

5. The driving control method of claim 4, wherein an interval length $T_{\Delta g_i_qxi}$ of a starting time of an allow-to-travel light signal emitted by the horizontal ground traffic light set i relative to the starting time of the allow-to-travel light signal emitted by the horizontal ground traffic light set qxi is expressed as $$T_{\Delta g_i_qxi} = T_{cd_xi}\frac{L_{i_qxi}}{L_{YD_xi}},$$

wherein $L_{YD_xi}$ represents a distance between the horizontal ground traffic light set pxi and the horizontal ground traffic light set qxi, and $L_{i_qxi}$ represents a distance between the horizontal ground traffic light set i and the horizontal ground traffic light set qxi.

6. The driving control method of claim 4, wherein an interval length $T_{\Delta g_i_qxi}$ of a starting time of an allow-to-travel light signal emitted by the horizontal ground traffic light set i relative to the starting time of the allow-to-travel light signal emitted by the horizontal ground traffic light set qxi is expressed as $$T_{\Delta g_i_qxi} = T_{cd_xi}\sqrt{\frac{L_{i_qxi}}{L_{YD_xi}}},$$

wherein $L_{YD_xi}$ represents a distance between the horizontal ground traffic light set pxi and the horizontal ground traffic light set qxi, and $L_{i_qxi}$ represents a distance between the horizontal ground traffic light set i and the horizontal ground traffic light set qxi.

7. The driving control method of claim 4, wherein an interval length $T_{\Delta g_i_qxi}$ of a starting time of an allow-to-travel light signal emitted by the horizontal ground traffic light set i relative to the starting time of the allow-to-travel light signal emitted by the horizontal ground traffic light set qxi is expressed as $$T_{\Delta g_i_qxi} = \frac{T_{cd_xi}\sqrt{(v_0 T_{cd_xi})^2 + 4L_{i_qxi}(L_{YD_xi} - v_0 T_{cd_xi})} - v_0 T_{cd_xi}^2}{2(L_{YD_xi} - v_0 T_{cd_xi})},$$

wherein the variable guide speed is an uniform acceleration guide speed, $v_0$ represents an initial speed of the uniform acceleration guide speed, $L_{YD_xi}$ represents a distance between the horizontal ground traffic light set pxi and the horizontal ground traffic light set qxi, and $L_{i_qxi}$ represents a distance between the horizontal ground traffic light set i and the horizontal ground traffic light set qxi.

8. The driving control method of claim 4, wherein the method further comprises one of:

driving the Nxi horizontal ground traffic light sets to synchronously emit a prohibit-to-travel light signal when the control phase of the entrance lane xi ends;

driving the Nxi horizontal ground traffic light sets to synchronously emit the prohibit-to-travel light signal when there is a clear phase time length left before the control phase of the entrance lane xi ends; and driving the Nxi horizontal ground traffic light sets to sequentially emit the prohibit-to-travel light signal from the horizontal ground traffic light set qxi when there is the clear phase time length left to the end of the control phase of the entrance lane xi, wherein the closer a distance between a horizontal ground traffic light set among the Nxi horizontal ground traffic light sets and the horizontal ground traffic light set qxi is, the earlier a starting time when the horizontal ground traffic light set emits a prohibit-to-travel light signal is; wherein a starting time of a prohibit-to-travel light signal emitted by the horizontal ground traffic light set pxi is later than that emitted by any horizontal ground traffic light set among the Nxi horizontal ground traffic light sets.

9. The driving control method of claim 4, wherein the method further comprises:

driving the Nxi horizontal ground traffic light sets to synchronously emit a warn-to-travel light signal when there is a transition phase time length left to the end of the control phase of the entrance lane xi;

driving the Nxi horizontal ground traffic light sets to synchronously emit the warn-to-travel light signal when there is a clear phase time length plus the transition phase time length left to the end of the control phase of the entrance lane xi;

driving the Nxi horizontal ground traffic light sets from the horizontal ground traffic light set qxi to sequentially emit the warn-to-travel light signal when there is the clear phase time length plus the transition phase time length left to the end of the control phase of the entrance lane xi; wherein the closer a distance between a horizontal ground traffic light set among the Nxi horizontal ground traffic light sets and the horizontal ground traffic light set qxi is, the earlier a starting time when the horizontal ground traffic light set emits a warn-to-travel light signal is; wherein a starting time of a warn-to-travel light signal emitted by the horizontal ground traffic light set pxi is later than that emitted by any horizontal ground traffic light set among the Nxi horizontal ground traffic light sets; and driving the Nxi horizontal ground traffic light sets from the horizontal ground traffic light set qxi to sequentially emit the warn-to-travel light signal when there is the transition phase time length left to the end of the control phase of the entrance lane xi, wherein the closer a distance between a horizontal ground traffic light set among the Nxi horizontal ground traffic light sets and the horizontal ground traffic light set qxi is, the earlier a starting time when the horizontal ground traffic light set emits a warn-to-travel light signal is; wherein the starting time of the warn-to-travel light signal emitted by the horizontal ground traffic light set pxi is later than that emitted by any horizontal ground traffic light set among the Nxi horizontal ground traffic light sets.

10. The driving control method of claim 9, wherein an interval of the starting time of a prohibit-to-travel light signal emitted by the horizontal ground traffic light set pxi and a starting time of the prohibit-to-travel light signal emitted by the horizontal ground traffic light set qxi or the starting time of the warn-to-travel light signal emitted by the horizontal ground traffic light set pxi and the starting time of the warn-to-travel light signal emitted by the horizontal ground traffic light set qxi is equal to a clear time length of an entrance guide area of the entrance lane xi, where the clear time length of the entrance guide area of the entrance lane xi is represented as $T_{YD_qk_xi}$, and $$T_{YD_qk_xi} = \frac{L_{YD_xi}}{V'_{YD_qk_xi}},$$

wherein $V'_{YD_qk_xi}$ equals to $V_{lk_max}$, $V_{lk_min}$, or $V_{lk_q}$, $V_{lk_max}$ represents a maximum speed limit at the plane intersection, $V_{lk_min}$ represents a minimum speed limit at the plane intersection, and $V_{lk_q}$ represents a desired speed at the plane intersection.

11. The driving control method of claim 10, wherein an interval length $T_{\Delta r_i_qxi}$ of a starting time of a prohibit-to-travel light signal emitted by the horizontal ground traffic light set i relative to the starting time of the prohibit-to-travel light signal emitted by the horizontal ground traffic light set qxi is expressed as $$T_{\Delta r_i_qxi} = T_{YD_qk_xi}\frac{L_{i_qxi}}{L_{YD_xi}},$$

wherein $L_{i_qxi}$ represents a distance between the horizontal ground traffic light set i and the horizontal ground traffic light set qxi.

12. A driving control apparatus for an intersection traffic light array, comprising:

a driving interface;

a processor; and a memory;

wherein the memory is configured to store a set of executable program codes; wherein the intersection traffic light array comprises Nxi horizontal ground traffic light sets; wherein the Nxi horizontal ground traffic light sets comprise a horizontal ground traffic light set pxi which is disposed at an intersection safety line position of an entrance lane xi of a plane intersection; wherein the Nxi horizontal ground traffic light sets further comprise a horizontal ground traffic light set qxi which is disposed at a stop line position of the entrance lane xi, and Nxi is an integer greater than 1; wherein each horizontal ground traffic light set of the Nxi horizontal ground traffic light sets comprises at least one traffic light, and part or all of traffic lights of a horizontal ground traffic light set i have at least one of a wireless driving signal input port and a wired driving signal input port; wherein the horizontal ground traffic light set i is one or any one of the Nxi horizontal ground traffic light sets;

wherein the processor is configured to invoke the executable program codes to:

drive the Nxi horizontal ground traffic light sets to emit an allow-to-travel light signal sequentially from the horizontal ground traffic light set qxi when a time length from the beginning of a control phase of the entrance lane xi to the end of a last intersection conflict control phase is equal to an overlap time length $T_{cd_xi}$; wherein the closer a distance between a horizontal ground traffic light set among the Nxi horizontal ground traffic light sets and the horizontal ground traffic light set qxi is, the earlier a starting time when the horizontal ground traffic light set is driven to emit an allow-to-travel light signal is; wherein a starting time of an allow-to-travel light signal emitted by driving the horizontal ground traffic light set pxi is later than that emitted by driving any horizontal ground traffic light set among the Nxi horizontal ground traffic light sets, and an interval $T_{\Delta_pxi_qxi}$ of the starting time of the allow-to-travel light signal emitted by the horizontal ground traffic light set pxi and a starting time of an allow-to-travel light signal emitted by the horizontal ground traffic light set qxi is equal to the overlap time length $T_{cd_xi}$.

13. The driving control apparatus of claim 12, wherein guide speed presented when the Nxi horizontal ground traffic light sets are driven to emit the allow-to-travel light signal sequentially from the horizontal ground traffic light set qxi is constant guide speed or variable guide speed.

14. The driving control apparatus of claim 13, wherein an interval length $T_{\Delta g_i_qxi}$ of a starting time of an allow-to-travel light signal emitted by the horizontal ground traffic light set i relative to the starting time of the allow-to-travel light signal emitted by the horizontal ground traffic light set qxi is expressed as $$T_{\Delta g_i_qxi} = T_{cd_xi}\frac{L_{i_qxi}}{L_{YD_xi}},$$

wherein $L_{YD_xi}$ represents a distance between the horizontal ground traffic light set pxi and the horizontal ground traffic light set qxi, and $L_{i_qxi}$ represents a distance between the horizontal ground traffic light set i and the horizontal ground traffic light set qxi.

15. The driving control apparatus of claim 13, wherein an interval length $T_{\Delta q_i_qxi}$ of a starting time of an allow-to-travel light signal emitted by the horizontal ground traffic light set i relative to the starting time of the allow-to-travel light signal emitted by the horizontal ground traffic light set qxi is expressed as $$T_{\Delta g_i_qxi} = T_{cd_xi}\sqrt{\frac{L_{i_qxi}}{L_{YD_xi}}},$$

wherein $L_{YD_xi}$ represents a distance between the horizontal ground traffic light set pxi and the horizontal ground traffic light set qxi, and $L_{i_qxi}$ represents a distance between the horizontal ground traffic light set i and the horizontal ground traffic light set qxi.

16. The driving control apparatus of claim 13, wherein an interval length $T_{\Delta g_i_qxi}$ of a starting time of an allow-to-travel light signal emitted by the horizontal ground traffic light set i relative to the starting time of the allow-to-travel light signal emitted by the horizontal ground traffic light set qxi is expressed as $$T_{\Delta g_i_qxi} = \frac{T_{cd_xi}\sqrt{(v_0T_{cd_xi})^2 + 4L_{i_qxi}(L_{YD_xi} - v_0T_{cd_xi})} - v_0T_{cd_xi}^2}{2(L_{YD_xi} - v_0T_{cd_xi})},$$

wherein the variable guide speed is an uniform acceleration guide speed, $v_0$ represents an initial speed of the uniform acceleration guide speed, $L_{YD_xi}$ represents a distance between the horizontal ground traffic light set pxi and the horizontal ground traffic light set qxi, and $L_{i_qxi}$ represents a distance between the horizontal ground traffic light set i and the horizontal ground traffic light set qxi.

17. The driving control apparatus of claim 13, wherein the processor is further configured to invoke the executable program codes to:

drive the Nxi horizontal ground traffic light sets to synchronously emit a prohibit-to-travel light signal when the control phase of the entrance lane xi ends;

drive the Nxi horizontal ground traffic light sets to synchronously emit the prohibit-to-travel light signal when there is a clear phase time length left before the control phase of the entrance lane xi ends; and drive the Nxi horizontal ground traffic light sets to sequentially emit the prohibit-to-travel light signal from the horizontal ground traffic light set qxi when there is the clear phase time length left to the end of the control phase of the entrance lane xi, wherein the closer a distance between a horizontal ground traffic light set among the Nxi horizontal ground traffic light sets and the horizontal ground traffic light set qxi is, the earlier a starting time when the horizontal ground traffic light set emits a prohibit-to-travel light signal is; wherein a starting time of a prohibit-to-travel light signal emitted by the horizontal ground traffic light set pxi is later than that emitted by any horizontal ground traffic light set among the Nxi horizontal ground traffic light sets.

18. The driving control apparatus of claim 13, wherein the processor is further configured to invoke the executable program codes to:

drive the Nxi horizontal ground traffic light sets to synchronously emit a warn-to-travel light signal when there is a transition phase time length left to the end of the control phase of the entrance lane xi;

drive the Nxi horizontal ground traffic light sets to synchronously emit the warn-to-travel light signal when there is a clear phase time length plus the transition phase time length left to the end of the control phase of the entrance lane xi;

drive the Nxi horizontal ground traffic light sets from the horizontal ground traffic light set qxi to sequentially emit the warn-to-travel light signal when there is the clear phase time length plus the transition phase time length left to the end of the control phase of the entrance lane xi; wherein the closer a distance between a horizontal ground traffic light set among the Nxi horizontal ground traffic light sets and the horizontal ground traffic light set qxi is, the earlier a starting time when the horizontal ground traffic light set emits a warn-to-travel light signal is; wherein a starting time of a warn-to-travel light signal emitted by the horizontal ground traffic light set pxi is later than that emitted by any horizontal ground traffic light set among the Nxi horizontal ground traffic light sets; and drive the Nxi horizontal ground traffic light sets from the horizontal ground traffic light set qxi to sequentially emit the warn-to-travel light signal when there is the transition phase time length left to the end of the control phase of the entrance lane xi, wherein the closer a distance between a horizontal ground traffic light set among the Nxi horizontal ground traffic light sets and the horizontal ground traffic light set qxi is, the earlier a starting time when the horizontal ground traffic light set emits a warn-to-travel light signal is; wherein the starting time of the warn-to-travel light signal emitted by the horizontal ground traffic light set pxi is later than that emitted by any horizontal ground traffic light set among the Nxi horizontal ground traffic light sets.

19. The driving control apparatus of claim 18, wherein an interval of the starting time of a prohibit-to-travel light signal emitted by the horizontal ground traffic light set pxi and a starting time of the prohibit-to-travel light signal emitted by the horizontal ground traffic light set qxi or the starting time of the warn-to-travel light signal emitted by the horizontal ground traffic light set pxi and the starting time of the warn-to-travel light signal emitted by the horizontal ground traffic light set qxi is equal to a clear time length of an entrance guide area of the entrance lane xi, where the clear time length of the entrance guide area of the entrance lane xi is represented as $T_{YD_qk_xi}$, and $$T_{YD_qk_xi} = \frac{L_{YD_xi}}{V'_{YD_qk_xi}},$$

wherein $V'_{YD_qk_xi}$ equals to $V_{lk_max}$, $V_{lk_min}$, or $V_{lk_q}$, $V_{lk_max}$ represents a maximum speed limit at the plane intersection $V_{lk_min}$ represents a minimum speed limit at the plane intersection, and $V_{lk_q}$ represents a desired speed at the plane intersection.

20. The driving control apparatus of claim 19, wherein an interval length $T_{\Delta r_i_qxi}$ of a starting time of a prohibit-to-travel light signal emitted by the horizontal ground traffic light set i relative to the starting time of the prohibit-to-travel light signal emitted by the horizontal ground traffic light set qxi is expressed as $$T_{\Delta r_i_qxi} = T_{YD_qk_xi}\frac{L_{i_qxi}}{L_{YD_xi}},$$

wherein $L_{i_qxi}$ represents a distance between the horizontal ground traffic light set i and the horizontal ground traffic light set qxi.

* * * * *